US006141933A

United States Patent [19]

McClinton

[11] Patent Number: 6,141,933

[45] Date of Patent: Nov. 7, 2000

[54] CURVILINEAR MASONRY BUILDING UNIT, METHOD OF APPLYING A GLAZE COMPOSITION THERETO, A WALL CORNER, A WALL CORNER COMPOSITE, A COLUMN COMPOSITE OR PORTION THEREOF, AND A MOLD FOR APPLYING GLAZE COMPOSITION TO A CURVILINEAR MASONRY BUILDING UNIT

[76] Inventor: John L McClinton, 7432 Hickory La., Hanover, Md. 21076

[21] Appl. No.: 08/202,254

[22] Filed: Feb. 25, 1994

[51] Int. Cl.[7] ..... E04B 2/08

[52] U.S. Cl. ..... 52/591.1; 52/245

[58] Field of Search ..... 52/284, 286, 596, 52/608, 609, 610, 612, 405.1, 405.2, 245; 404/34, 42

[56] References Cited

U.S. PATENT DOCUMENTS

D. 346,224 4/1994 McClinton et al. .
2,751,775 6/1956 Sergovic .
3,328,231 6/1967 Sergovic .
4,031,289 6/1977 Sergovic .
4,041,670 8/1977 Kaplan ..... 52/591
4,329,822 5/1982 Russell .
4,478,779 10/1984 Russell et al. .
4,533,568 8/1985 McClinton et al. .
4,555,375 11/1985 Sergovic et al. .
4,572,699 2/1986 Rinninger ..... 52/608 X
4,769,961 9/1988 Gillet ..... 52/245
4,821,479 4/1989 Lucak ..... 52/603
5,212,925 5/1993 McClinton .
5,285,611 2/1994 McClinton .
5,384,997 1/1995 McClinton .
5,393,471 2/1995 Rich .
5,398,474 3/1995 McClinton .
5,410,848 5/1995 McClinton et al. .

*Primary Examiner*—Kien T. Nguyen
*Attorney, Agent, or Firm*—Pollock, Vande Sande & Amernick

[57] ABSTRACT

A curvilinear masonry building unit, having a front face, a back face, a top face, a bottom face, and two side faces. The front face includes a curvilinear portion that is opposite to the back face.

13 Claims, 28 Drawing Sheets

CURVILINEAR MASONRY BUILDING UNIT, METHOD OF APPLYING A GLAZE COMPOSITION THERETO, A WALL CORNER, A WALL CORNER COMPOSITE, A COLUMN COMPOSITE OR PORTION THEREOF, AND A MOLD FOR APPLYING GLAZE COMPOSITION TO A CURVILINEAR MASONRY BUILDING UNIT

FIELD OF THE INVENTION

The present invention is concerned with curvilinear masonry building units and a method of glazing curvilinear building units. The invention is also concerned with forming corners and corner composites in a wall construction containing at least one curvilinear masonry building unit of particular configuration. In addition, the present invention is concerned with column composites, or portions thereof constructed from at least two curvilinear masonry building units of particular configuration. The invention is further concerned with a mold for applying a glaze composition to curvilinear masonry building units and a method for applying a glaze composition to such units.

BACKGROUND OF THE INVENTION

Filled polymeric materials have been known to provide decorative and protective surfaces to walls. For instance, it has been known to coat masonry units filled with polyesters and to form walls therefrom. The basic patent on the use of polyester as coating for masonry units is U.S. Pat. No. 2,751,775 to Sergovic and assigned to the assignee of the present invention. Over the years, a number of improvements in the coating compositions for the masonry building units have been developed. For instance, U.S. Pat. No. 3,328,231 to Sergovic and assigned to the assignee of the present invention, discloses a glazed masonry building block of a cured composition of unsaturated polyester resin and sand in which the sand comprises at least 50% by weight of the coating composition. The unsaturated polyester is derived from a reaction between a dicarboxylic acid such as phthalic, maleic, fumaric, adipic, pimelic, suberic, itaconic, citraconic, succinic acids, and/or an anhydride thereof, and a polyhydric alcohol such as ethylene glycol, diethylene glycol, and propylene glycol. Also present in such compositions is an unsaturated monomer, such as methyl methacrylate styrene, diallyl phthalate, t-butyl styrene, and alpha-methyl styrene. Furthermore, U.S. Pat. No. 4,031,289 to Sergovic discloses coated masonry building blocks, articles and compositions therefore that employ resinous pigments and chemicals in combination with various resinous compositions to provide stain resistance when subjected to high moisture conditions and/or staining media. The disclosures of the above-mentioned U.S. Pat. Nos. 2,751,775; 3,328,231 and 4,031,289 are incorporated herein by reference.

Constructing walls with glazed masonry building units presents particular problems with respect to the formation of outside corners of the wall structure. For example, glazed cinder or concrete blocks at corners and intersecting wall planes must be glazed on more than one side, in particular, one face and one end or one face and one top provided they are intersecting, in order for the glazed material to show when turning a corner.

Known attempts to construct outside corners using glazed masonry building units involved forming the corner from one or more blocks having flat surfaces. The corner, which may be formed from flat surfaces on the exterior of one more blocks, may be a sharp 90° corner formed by the intersection of the exterior surfaces of the two walls. Alternatively, the corner may be formed from one or more angled flat surfaces formed by one or more exterior walls on adjoining masonry building units. For example, see FIGS. 1–4. Another attempt to overcome the problems associated with constructing outside corners is disclosed in U.S. Pat. No. 4,329,822 to Russell and assigned to the assignee of the present application. In particular, U.S. Pat. No. 4,329,822 discloses a corner wall facing unit that includes a unit that is not supported by a concrete block and must be supported using a non-block supported wall system or wire meshing and is time-consuming to erect. Although such a system has been quite effective such non-self-supporting units tend to be relatively heavy for their size which requires the use of temporary wedges to prevent slippage and sagging in the mortar used between the wall unit during erection. Also, such units require special insulation care, and do not assure structural integrity.

Moreover, turning a corner, e.g.—a 90° corner or more, has been carried out by employing a single piece angled block in conjunction with a glazed straight wall unit (see FIG. 3). Such a corner would be used to create a wall angle in the exposed face by employing one angle glazed block and will always be connected to a straight wall unit without the use of a second corner piece or angled glazed block. The return employed on these prior angle and glazed blocks is relatively deep, i.e. at least about three and three quarters inches. The use of such a single piece angled glazed block not only requires a fill piece adding to the complexity of the arrangement. The angled glazed blocks are merely an angled version of the 90°, 4 inch, 6 inch, 8 inch, or 12 inch single core units.

Constructing walls with glazed masonry building units also presents particular problems with respect to the formation of the outside corner of the wall structure. For example, glazed cinder or concrete blocks at corners and intersecting wall planes must be glazed on more than one side, in particular when one face and one end or one face and one top provided that they are intersecting, in order for the glaze material to shown when turning a corner. However, attempts to glaze two intersecting sides of a masonry block have not been entirely successful and have suffered from a number of problems. For example, the percent of factory culls or rejects generated when making a corner or cap block with two more surfaces glazed simultaneously is greater than the percent of culls generated when glazing a single face or plane to form a straight wall unit (referred to in the art as "stretchers").

When making a unit with two intersecting glazed planes, a mold which has two intersecting planes is used. The space between the vertical plane of the mold and the concrete block requires special care when filling to assure the removal of entrapped air in the glazing material. This results in air bubbles which become pin holes in the return end of corner units. Also, the differences in sand settlement can cause lines at the intersecting planes of the corner.

Rejected glazed corner blocks result in about 5 to about 10% loss as compared to only about a 0.5% to a 2% loss for coated "stretchers". In particular, defects in the finished products are manifested in the formation of unsightly lines at the intersecting lanes of the decorative surfaces of the corner units, unsightly pin holes and differences in the color appearance of the intersecting surface planes of such blocks.

SUMMARY OF THE INVENTION

The present invention overcomes many of the problems in the prior art by providing a curvilinear masonry building unit. Forming masonry building units and applying a glaze composition to such blocks may suffer from some of the same problems described above. Curvilinear masonry building units may suffer not only from the problems of cracks in the blocks but also the glaze. Further, due to the differences in the thermal characteristics of the block and the glaze, problems may arise from the thermal expansion of curvilinear masonry building units. The above-described problems may result in a vary limited use for curvilinear masonry building units.

The present invention also provides a system that may utilize a composite construction of two curvilinear masonry units for constructing a corner. Moreover, it is not known in the art to turn corners using curvilinear masonry building units such as those of the present invention, whether glazed or unglazed. A corner constructed according to the present invention exhibits a superior looking wall and corner along with a higher level of acceptance at the job site and a reduced percentage of rejected materials at the manufacturing site.

When two walls intersect at right angles, the present invention provides for eliminating a mortar joint at the extreme corner and moves the mortar joint to a point down the wall away from the extreme corner of the wall. Such a wall corner is more architecturally aesthetic than the traditional mortar falling directly at the extreme intersection of the two walls. In addition, the present invention makes it possible to achieve the benefits of a mitre joint on an integral wall construction without the problems of having any mortar joint visible at the extreme corner of the construction, and without using a connecting unit as shown, for example, by U.S. Pat. No. 4,329,822 as a spacer to turn the corner.

In addition, the present invention provides for having self-supporting main wall units integrated.

In an alternative embodiment, the present invention is concerned with providing a curvilinear masonry unit for use in constructing a corner that is structurally reinforced. The curvilinear masonry unit for this purpose can be unglazed but preferably is glazed.

More particularly, one aspect of the present invention is concerned with a curvilinear masonry unit including a front face, a back face, a top face, a bottom face, and two side faces. The front face includes a curvilinear portion that is opposite to the back face.

The reference to the location of the faces of the units such as front, back, top, bottom and side is used herein to denote the relationship of the various faces to each other but is not intended to denote the orientation of the unit in a particular building construction. In addition, the various angles of the finished intersecting faces can be sharply defined as illustrated in various figures or can be somewhat rounded. When rounded, it is typically rounded with a radius of about one-half inch to about three inches, and more typically about one inch.

A further aspect of the present invention is concerned with a wall corner comprising at least one curvilinear masonry building unit. The curvilinear masonry building unit includes a front face, back face, top face, bottom, and two side faces. The front face is intended to be exposed and comprises a curvilinear portion that is opposite to the back face. The curvilinear portion intersects the side faces, top face, and bottom face.

According to a still further aspect of the present invention, the wall corner may be a composite including two or more curvilinear masonry building units.

In an alternative embodiment of the present invention, there is provided a composite providing a column or portion thereof that employs at least two curvilinear masonry building units of the types disclosed hereinabove. The curvilinear masonry building units are oriented such that the side of one curvilinear masonry building unit is opposed to the opposite side face of a second curvilinear masonry building unit.

A further aspect of the present invention is concerned with a method of applying a glaze composition to a curvilinear masonry building unit. The masonry building unit is substantially as described above. The glaze composition is applied according to the method comprising the step of applying glaze composition to a mold comprising at least a curvilinear segment. The curvilinear segment of the mold has a curvature substantially similar to the curvilinear portion of the front face of the masonry building unit.

According to the method, the front face of the masonry building unit is contacted with the surface of the glaze composition and the mold. The masonry building unit is simultaneously vibrated and forced into the glaze composition. The glaze is then cured and the resulting glazed masonry building unit is then removed from the mold.

The invention also provides a mold for applying a glaze composition to curvilinear masonry building units.

DETAILED DESCRIPTION OF BEST AND VARIOUS MODES FOR CARRYING OUT THE INVENTION

Figure 5:
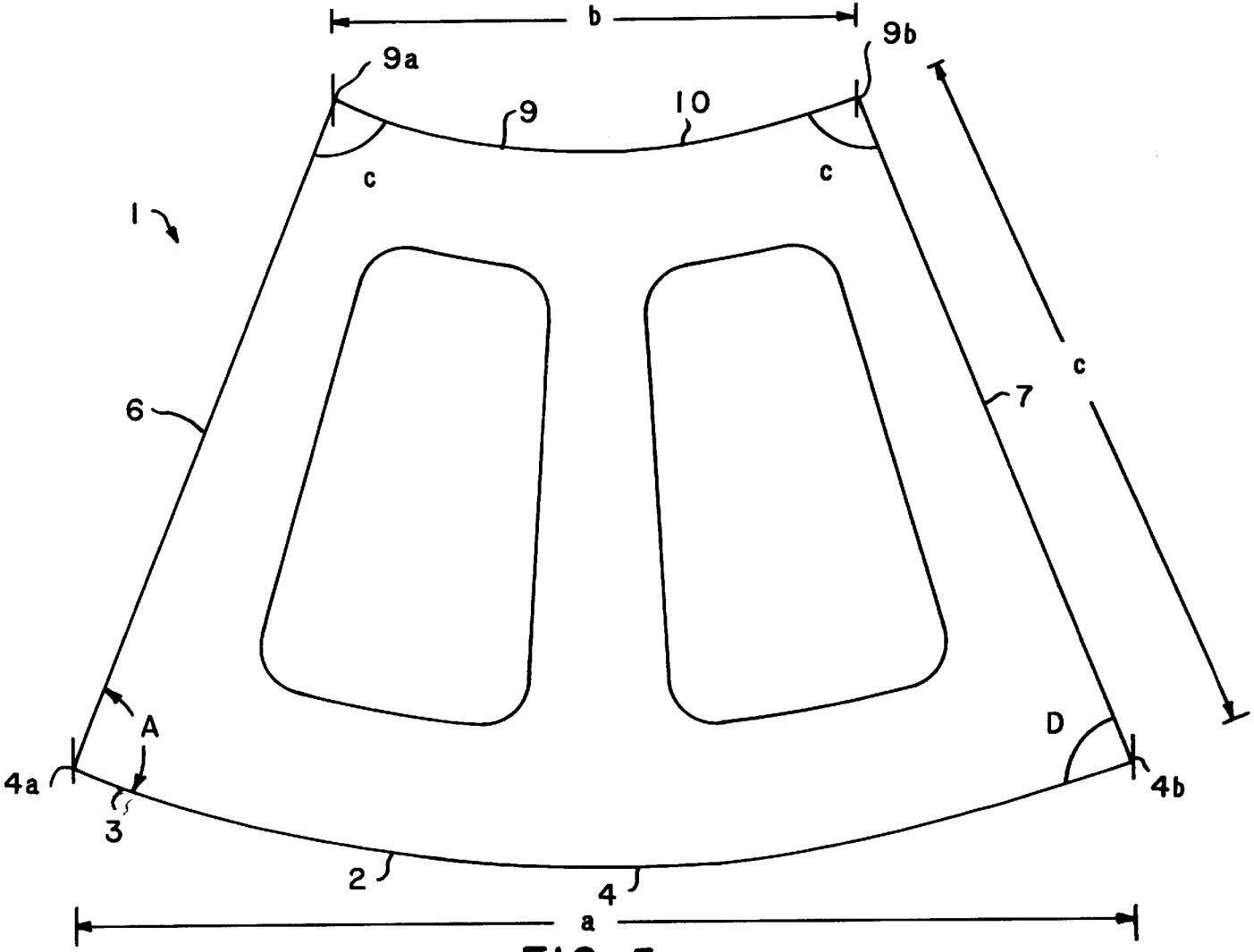
FIG. 5 represents a top elevational view of one embodiment of a curvilinear masonry building unit according to the present invention.

In order to facilitate an understanding of the present invention, reference is made to the figures. In particular, FIG. 5 is a top elevational view of a curvilinear masonry building unit 1 pursuant to the present invention. The curvilinear masonry building unit 1 may be made from materials commonly employed to produce masonry blocks such as cinders, slag, cement, haydite, clay, or the like. The front face 2 and/or back face 9 of the curvilinear masonry unit 1 may include a glaze 3. Examples of suitable glaze compositions are based upon the unsaturated polyester resin compositions disclosed in U.S. Pat. Nos. 2,751,775; 3,328,231; 3,632,725; 4,031,289; and 4,329,822; the entire disclosures of which are hereby incorporated by reference and relied upon. The glazed face(s) of the curvilinear masonry unit, whether the front face, the back face, or both is that face which is intended to be exposed to the environment in which the unit is employed in a building application. Alternatively, if used in an interior application, the glazed face(s) is intended to be exposed to view.

Figure 6:
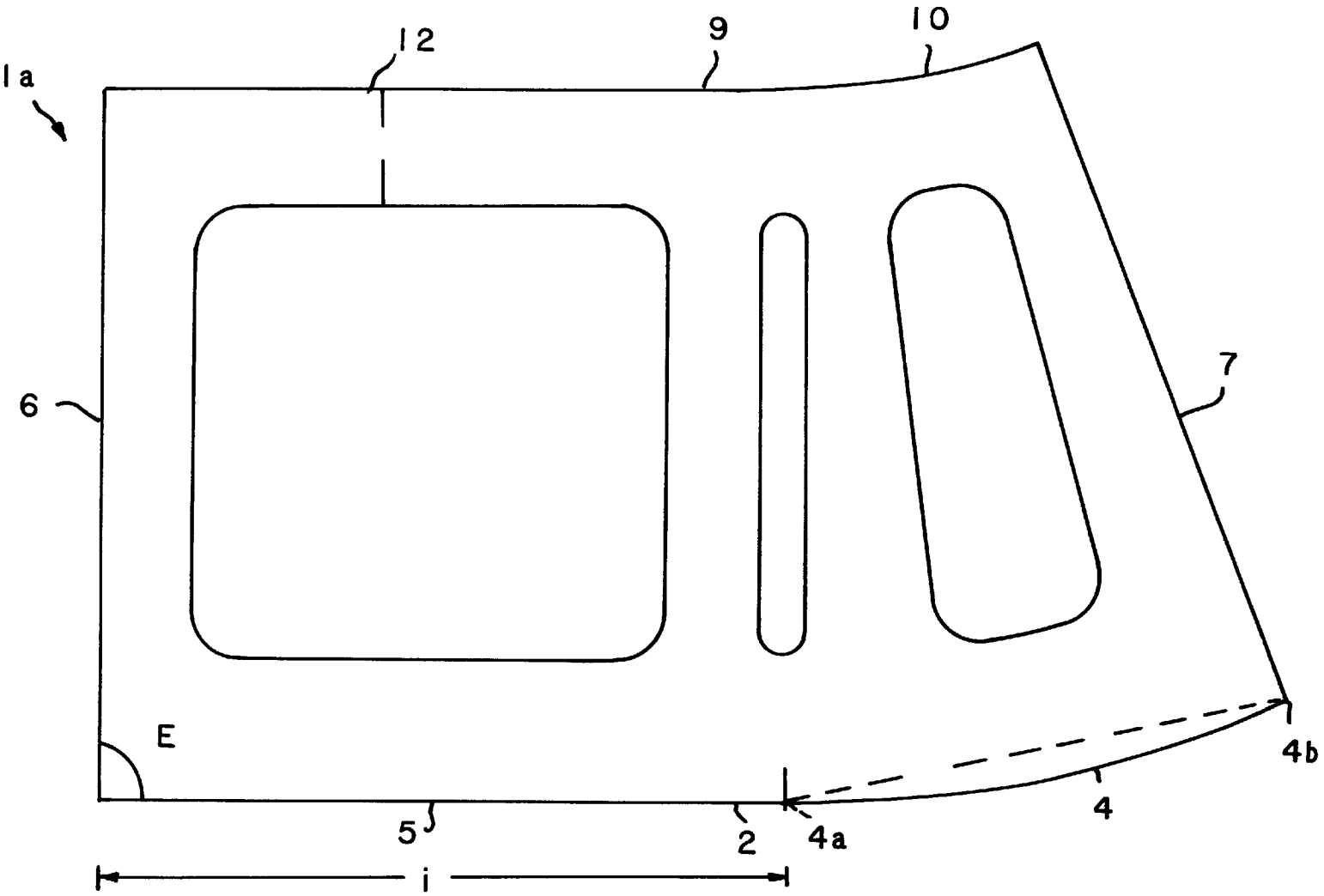
FIG. 6 represents a top elevational view of another embodiment of a curvilinear masonry building unit pursuant to the present invention.

The front face 2 of the curvilinear masonry unit 1 includes a curvilinear portion 4 which is opposite to a back face 9 of the curvilinear masonry building unit 1. The back face 9 may also include a curvilinear portion. As shown in FIG. 6, the front face 2 of the curvilinear masonry building unit 1 may also include a planar portion 5 that is also opposite to the back face 9. Preferably, the planar portion blends into the curvilinear portion without forming a sharp distinct angle or corner.

In the present invention, the front face is generally used to refer to a face including a convex curvilinear portion. The back face is generally used to refer to a face including a concave curvilinear portion. However, the front and back faces of a curvilinear masonry building unit according to the present invention are not limited to including convex and concave portions respectively. The curvature of the curvilinear portions of the faces may be reversed. Alternatively, the only one of the faces may include a curvilinear portion while the other face may or may not include a curvilinear portion. Further, either the front face, the back face, or both may be exposed, regardless of whether they are glazed.

In further embodiments, the front face 2 may comprise two planar portions joined to the curvilinear portion 4 on opposite sides. In such embodiments, the planar portions may be of different or may be the same length. The second planar portion preferably is also opposite the back face 9 of the curvilinear masonry building unit 1. Embodiments of the present invention masonry building unit 1 in which the front face 2 comprises one or more planar portions, may include a back face 9 which includes planar portions formed opposite the planar portions on the front face 2.

Whether the front face includes one or two planar portions, the planar portions may be of any length. The length of the planar portion(s) of the front face 2 is not dependent upon the length of the curvilinear portion 4 of the front face 2. Similarly, the length of one or the other of the planar portions and an embodiment including two planar portions is not dependent upon the other planar portion. In the embodiment shown in FIG. 6, the planar portion 5 of the front face 2 of the curvilinear masonry building unit 1, including is about 7.625 inches long as represented by i. The length of a planar portion of a curvilinear masonry building unit according to the present invention typically is about one-half of the length of the stretcher.

Whether or not the front face 2 of the curvilinear masonry building unit 1 of the present invention includes one or two planar portions may depend upon how the unit is being used and, for instance, the space in which a corner is desired to be turned. If the corner is to be turned in a relatively short distance, the planar portions or the one planar portion may be in the present invention. However, two planar portions may be included in the present invention and still allow a tight corner to be formed. For instance, the curvilinear portions of the front face 2 of the curvilinear masonry building unit 1 of the present invention may represent an arc of a large number of degrees therefore eliminating the necessity of turning a corner with more than one curvilinear masonry building unit.

As stated above, the number of degrees of arc represented by the curvilinear portion 4 of the front face 2 of the curvilinear masonry building unit 1 is variable. In the embodiment shown in FIG. 5, the curvilinear portion 4 of the front face 2 of the curvilinear masonry building unit 1 represents a section of a circle having about a 15 inch radius. The linear length of the arc is about 12 inches, representing approximately 45.84° of such a 15 inch radius circle. The linear distance between the corners 4*a* and 4*b* of the curvilinear masonry building unit, which represent the ends of the curvilinear portion of the front face 4*a* and 4*b*, are separated by linear distance a of about 11.5 inches. However, the size of the curvilinear portion 4 of the unit 1 may vary.

In a typical curvilinear masonry building unit according to the present invention, a curvilinear portion of the front face or back face may be from about one-sixteenth of the circumference circle (22.5°) to about one-quarter of the circumference of a circle (90°). Additionally, in typical embodiments, the height of the curvilinear masonry building units is from about 2 inches to about 16 inches.

For instance, in the embodiment shown in FIG. 6, the curvilinear portion 4 of the front face 2 of the curvilinear masonry building unit 1 is also a section of a circle with a 15 inch radius. However, the curvilinear portion 4 of the front face 2 of the curvilinear masonry unit 1 shown in FIG. 6 represents a smaller portion of that circle than the curvilinear portion 4 of the front face 2 of the curvilinear masonry building unit 1 shown in FIG. 5. In the embodiment shown in FIG. 6, the ends 4*a* and 4*b* of the curvilinear section may be about 5.625 inches apart in the straight line distance. However, the size of the curvilinear portion may be the same as the embodiment shown in FIG. 5 or 6 may be larger or smaller, depending upon the application.

Figure 1:
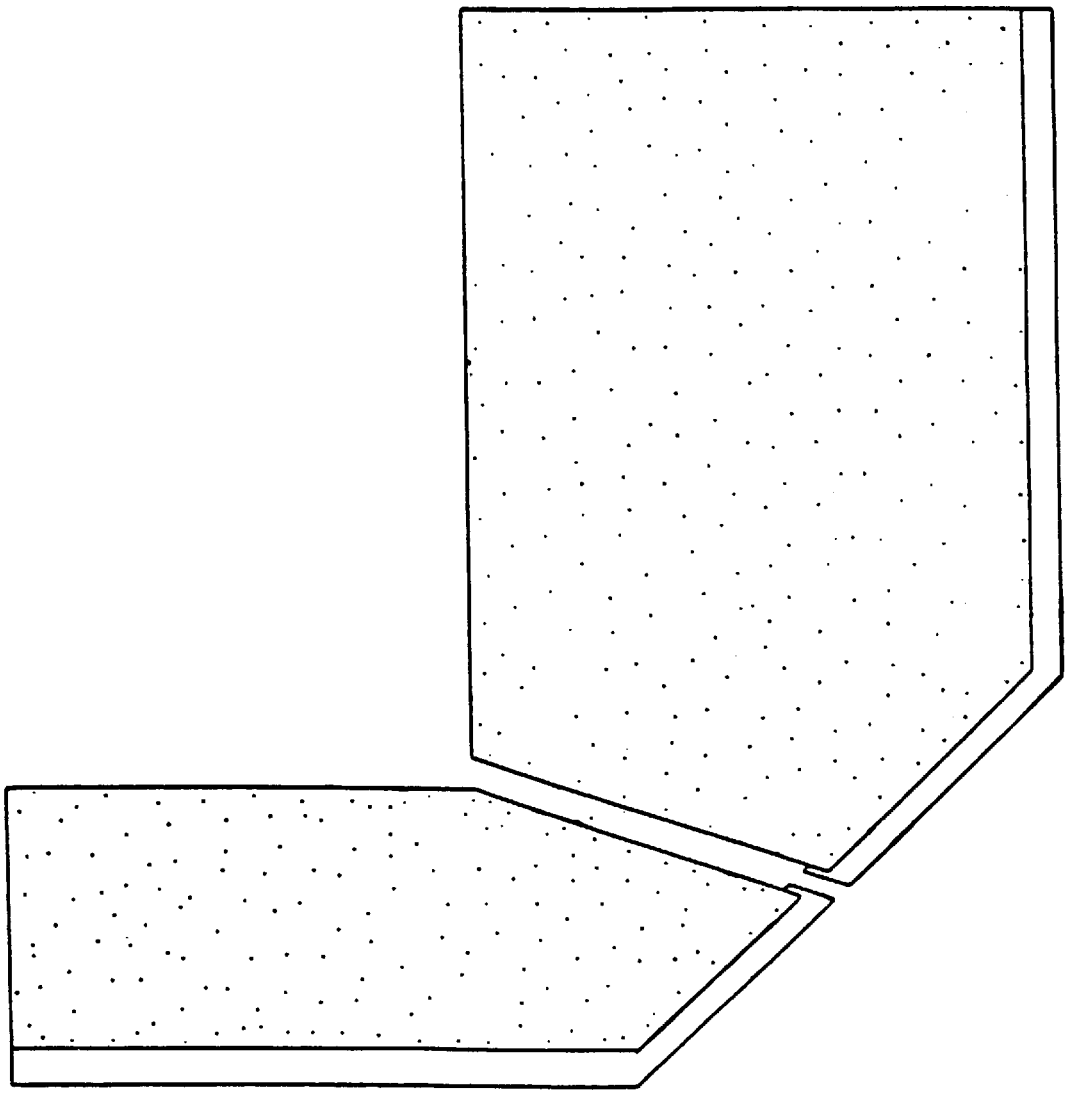
FIG. 1 represents an isometric view of a section of a prior art wall.
Figure 2:
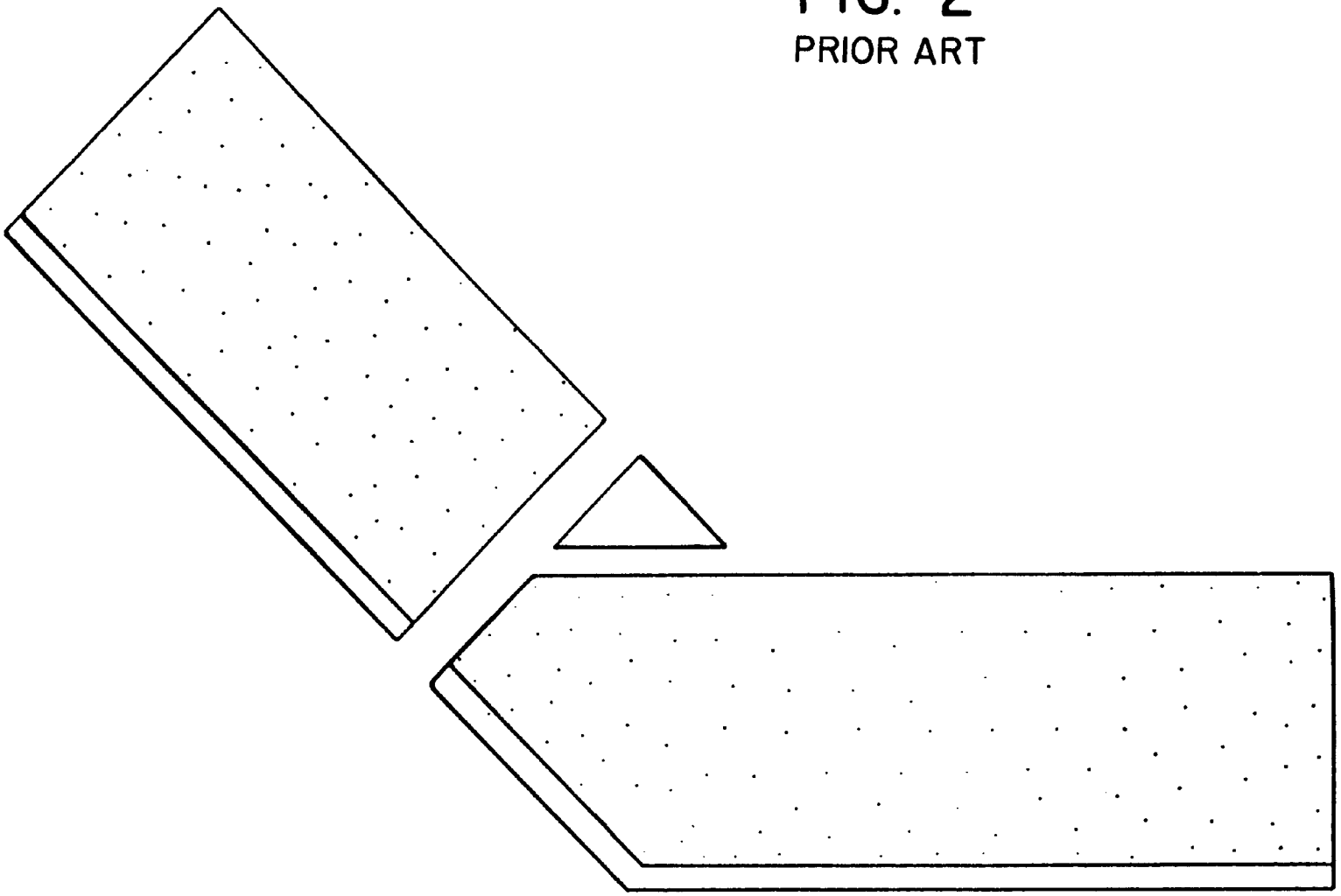
FIG. 2 PRIOR ART
FIG. 2 represents a top elevational view of two prior art adjoining angled masonry units.
Figure 3:
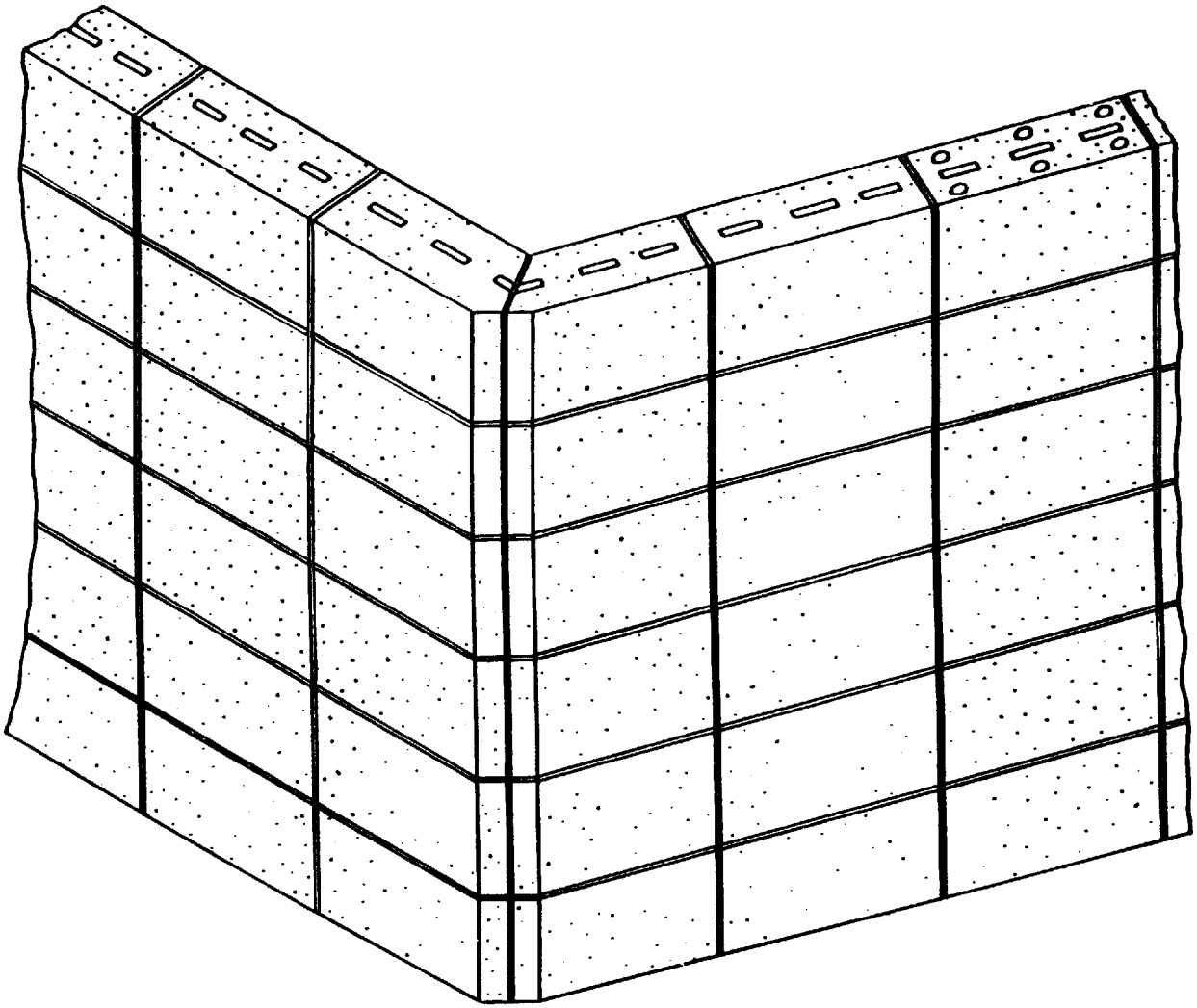
FIG. 3 represents a side view of a prior art corner turn.
Figure 4:
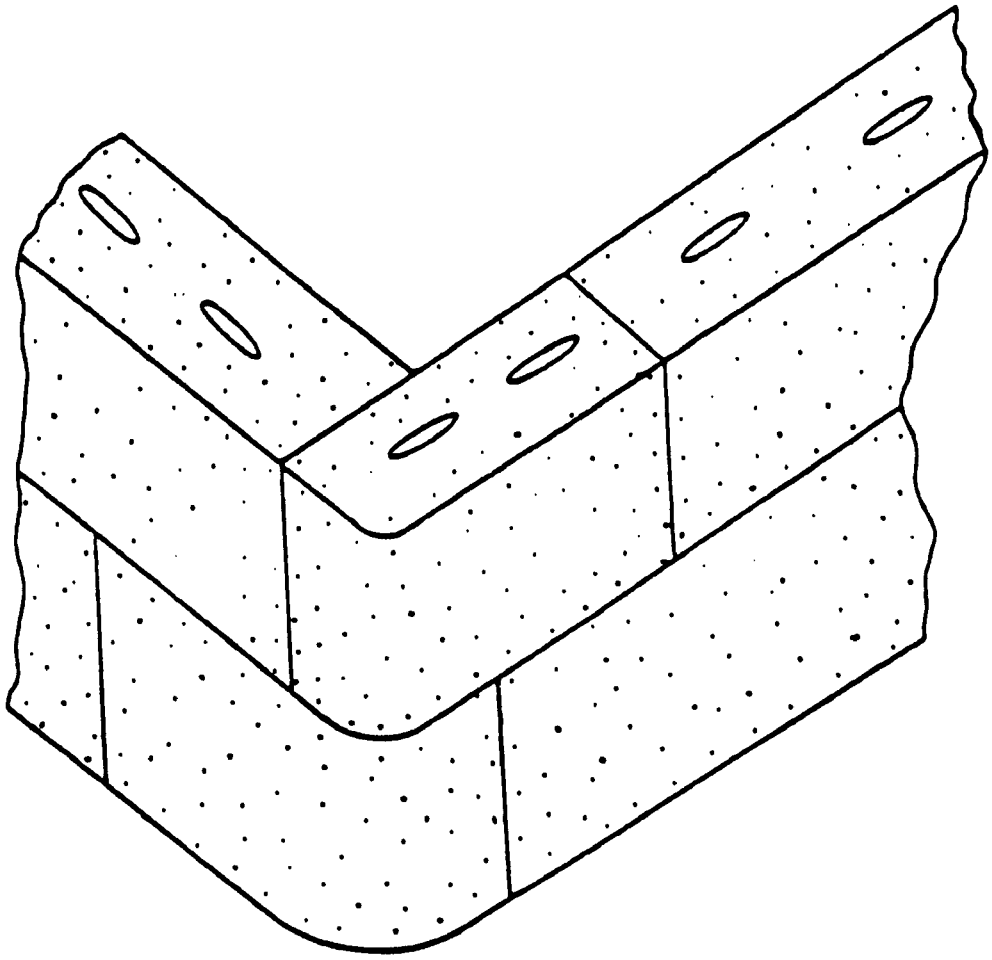
FIG. 4 PRIOR ART
FIG. 4 represents an isometric view of another prior art corner turn.

Further, although the curvilinear sections 4 of the front faces 2 of the curvilinear masonry building shown in FIG. 5 and 2 comprise a curvilinear section substantially similar to a portion of a circle, the curvilinear portion of the front face of the masonry building units according to the present invention may be formed according to another curve, such as parabolic, hyperbolic, or any other curve.

The front face 2 of the curvilinear masonry building unit, regardless of whether it includes planar portions or not, intersects at its ends with side faces 6 and 7. In the embodiment shown in FIG. 5, the side faces 6 and 7 intersect the curvilinear portion 4 of the front 2 of the curvilinear masonry building unit 1. On the other hand, in the embodiment shown in FIG. 6, the side face 6 intersects the planar portion 5 of the front face 2 while the side face 7 intersects the curvilinear portion 4 of the front face 2. When the side face intersects a planar portion included on a front face of a curvilinear masonry building unit according to the present invention, the side face preferably intersects the planar portion of the front face at a right angle E as shown in FIG. 6. However, if it is desired that a curvilinear masonry building unit according to the present invention abut another masonry building unit at a different angle, the angle E between the side face 6 and the planar portion 5 of the front face 2 may be greater or less than 90°.

The intersection between one of the side faces 6 or 7 and a curvilinear portion of the front face 4 of the curvilinear masonry building unit 1 preferably also forms a 90°, as radius of a circle having a circumference matching the curvature of the curvilinear portion of the front face of the unit 1. Therefore, the side face 7 intersecting the curvilinear portion of the curvilinear masonry building unit would form a right angle with a tangent to the point on the curvilinear portion where the side face 6 or 7 intersects the curvilinear portion 4. However, a side face intersecting a curvilinear portion of the front face may be formed at any angle to the front face. For instance, the side faces of a curvilinear masonry building unit shown in FIG. 5 may be formed parallel to each other. Alternatively, the side face may be formed at a smaller angle to the curvilinear portion of the front face of the curvilinear masonry building unit so that the side faces approach more closely than they do in the embodiment shown in FIG. 5. The side face may actually intersect the front face at any desirable angle for the application involved.

Regardless of what angle they form with the front face, the side faces 6 and 7 may be planar as in the embodiments shown in FIGS. 5 and 6. In typical embodiments in which either the front and/or back faces include a curvilinear portion, or in the embodiment shown in FIG. 6 having a planar side face 6 intersecting a planar section of the front face 2 of the unit, the side faces, including the glaze composition, may be about 7.625 inches long. A raw block used to form such a glazed block typically has side faces with a length of about 7.5 inches. However, the side faces may be of any desired length for a particular application and also depending upon the desired structural strength of the curvilinear masonry building unit.

Figure 14:
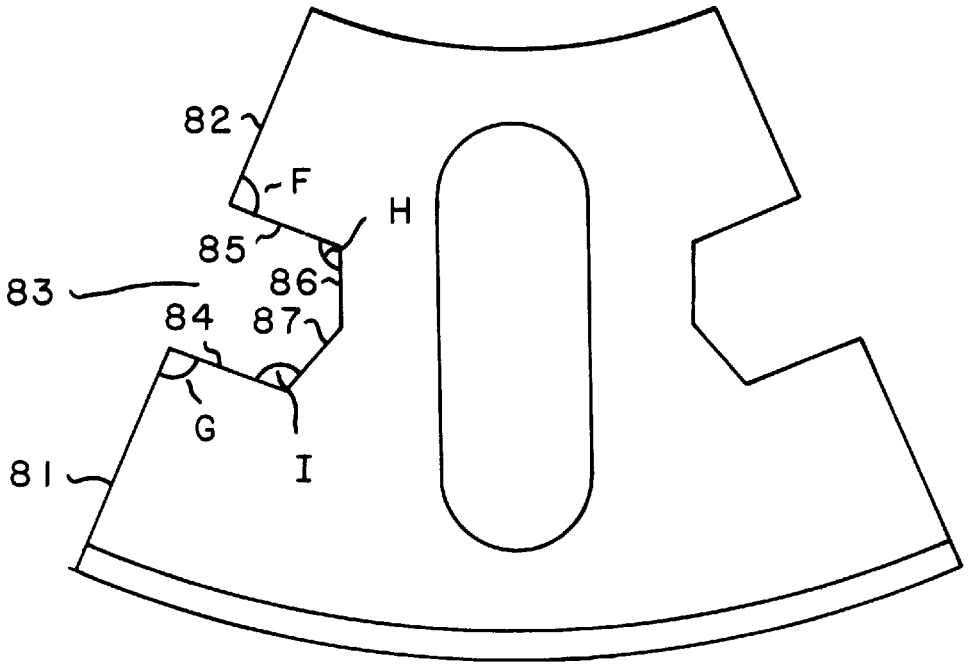
FIGS. 14–16 represent top elevational views of curvilinear masonry building units having a cut out portion in a side wall pursuant to an alternative embodiment of the present invention.

In alternative embodiments of the present invention, the side faces may include two end segments 81 and 82 with a cut-out portion located therebetween. In this embodiment, as shown in FIG. 14, the end segments may be planar and are typically about one to two inches long. A cut-out portion 83 located between the segments may be between three and six inches wide. The size of the end segments 81 and 82 and the cut-out portion may be larger or smaller, depending upon the size of the curvilinear masonry building unit and the application. The cut-out portion may include opposing side walls 84 and 85 which may be of variable length depending upon the size of the cut-out portion 83 desired. In a typical embodiment, the side walls 84 and 85 are about one inch long.

The side walls 84 and 85 preferably intersect the segments 81 and 82 of the side faces 6 or 7 at an angle F and G, respectively. The angle which is preferably, but not necessarily, about a 90° angle or less. Also, these side walls 84 and 85 intersect further side walls 6 and 7 respectively with an angle H and I, respectively. Angles H and I, which may vary depending upon the number of side walls included in the cut-out portion in a typical embodiment, are about 135°.

Figure 15:
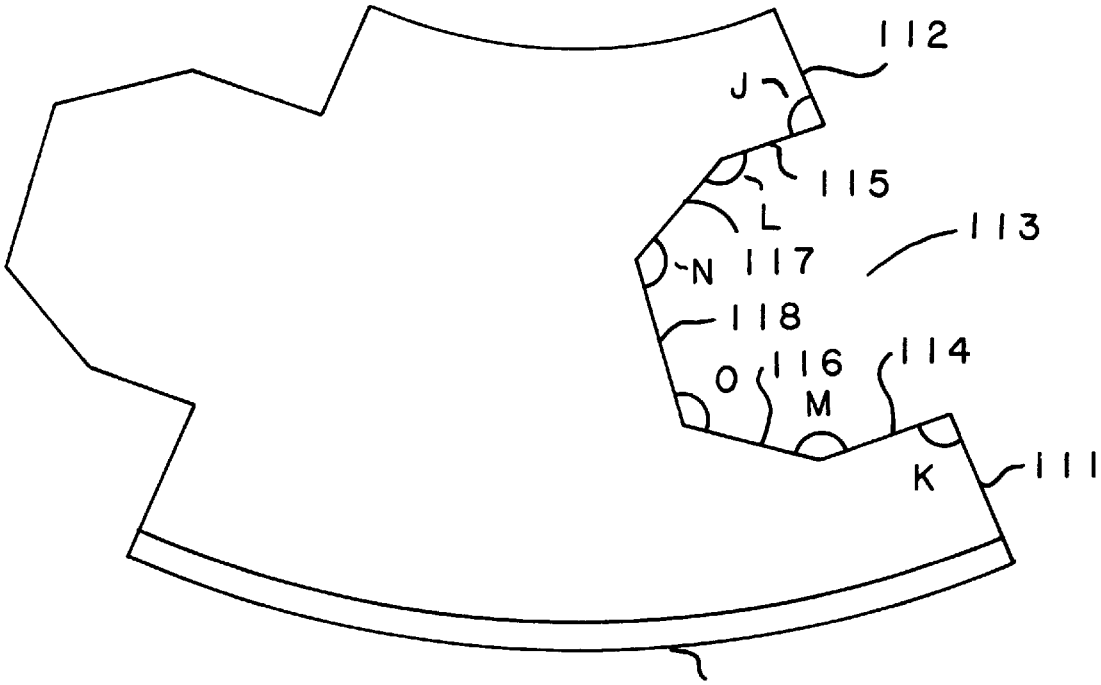

The side faces may include two end segments 111 and 112 with a cut-out portion 113 located therebetween. In this embodiment, shown in FIG. 15, the end segments 111 and 112 may be planar and are typically about one to two inches long. A cut-out portion 113 located between the segments may be between four and six inches wide. The cut-out portion may include opposing side walls 114 and 115 which may be of variable length depending upon the size of the cut-out portion 83 desired. The size of the end segments 111 and 112 and the cut-out portion may be larger or smaller, depending upon the size of the curvilinear masonry building unit and the application. In a typical embodiment, the side walls 114 and 115 are about one inch long.

The side walls 114 and 115 preferably intersect the segments of the side faces 111 and 112 at an angle J and K, respectively, which is preferably, but not necessarily, a 90°.

Also, these side walls 114 and 115 intersect further side walls 116 and 117, respectively, with an angle L and M, respectively. Angles L and M, which may vary depending upon the number of side walls included in the cut-out portion in a typical embodiment, are about 135°.

In this embodiment, preferably, the walls 116 and 117 intersect a bottom portion 118 of the cut-out portion at angles N and O, respectively. Angles N and O in a typical embodiment are about 135°. Also in a typical embodiment, walls 116 and 117 are about 2.0 inches, bottom wall is about 2.50 inches wide. Preferably, in a typical embodiment the cut-out portion 113 is about 2.50 inches deep.

Figure 16:
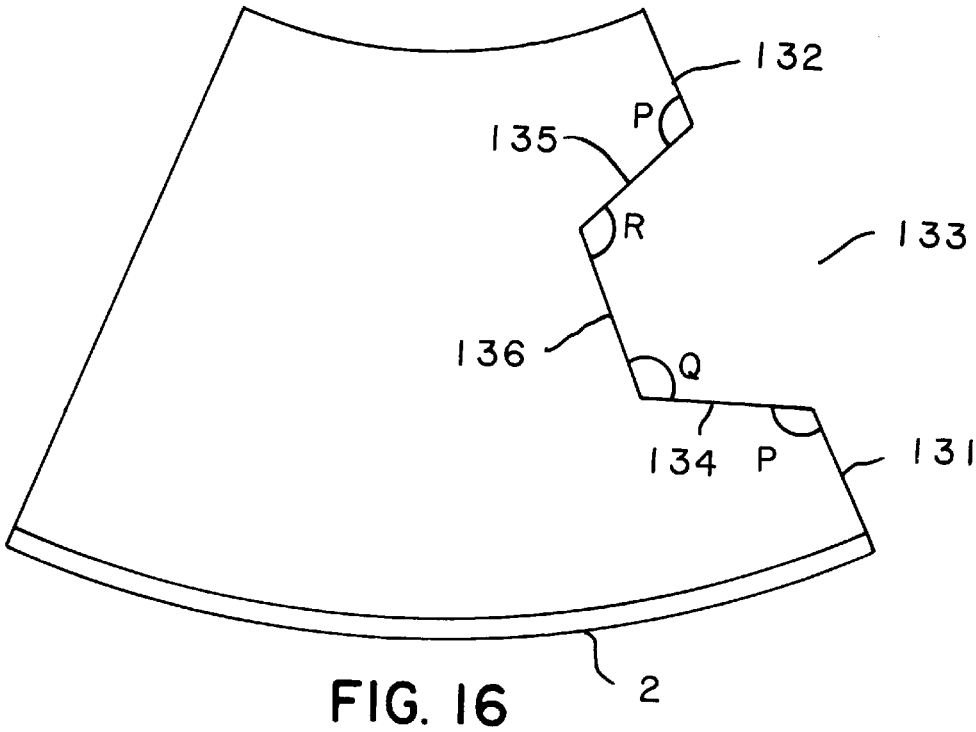

In an alternative embodiment, shown in FIG. 16, the cut-out may be bordered by side wall portions about 1.625 inches long and about 5.75 inches long. The cut-out portion in this embodiment is about 6.875 inches wide. The side walls intersect side walls 134 and 135 of the cut-out portion which in this embodiment are, respectively, about 3.625 inches long. Side walls 134 and 135 intersect segments 131 and 132, respectively, at the angle P which is preferable but not necessarily a 135° angle. Also, side walls 134 and 135 intersect bottom portion 136 of the cut-out portion, respectively, Q and R, which in this embodiment are each about 135°. The bottom portion 136 of the cut-out 133 in this embodiment is about 1.75 inches long and the cut-out portion is about 1.50 inches deep.

Figure 17:
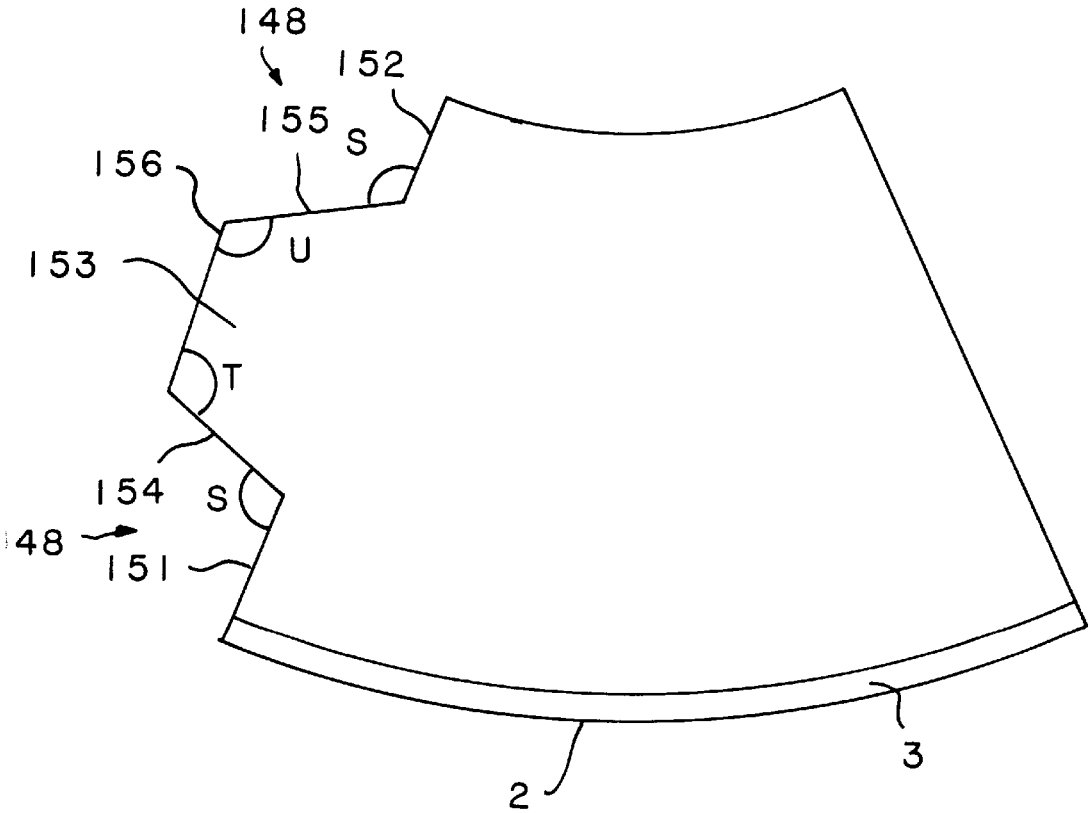
FIG. 17 represents a top elevational view of a curvilinear masonry building unit having a protuberance portion that mates with the cut out portion in the side wall shown in FIG. 16.

As shown in FIG. 17, one of the side faces of a curvilinear masonry building unit according to the present invention may have a protuberance portion 153 that is designed to mate with a cut-out portion of the side wall as described above and as shown in FIG. 16. The side face 148 of such a curvilinear masonry building unit preferably includes 151 and 152 with a protuberance 153 located therebetween. In this embodiment, side face segment 151 preferably is about 1.75 inches long, side face segment 152 preferably is about 5.75 inches long and the protuberance is about 6.875 inches wide at its widest. Preferably, the protuberance is tapered and includes opposing side walls 154 and 155 which, in this embodiment, are about 3.625 inches long. Side walls 154 and 155 intersect segments 151 and 152 respectively, at an angle S which is preferably, but not necessarily a 135°. Side walls 154 and 155 intersect wall 156, respectively, at angles T and U. Angles T and U in this embodiment are each preferably about 135°.

Figure 18:
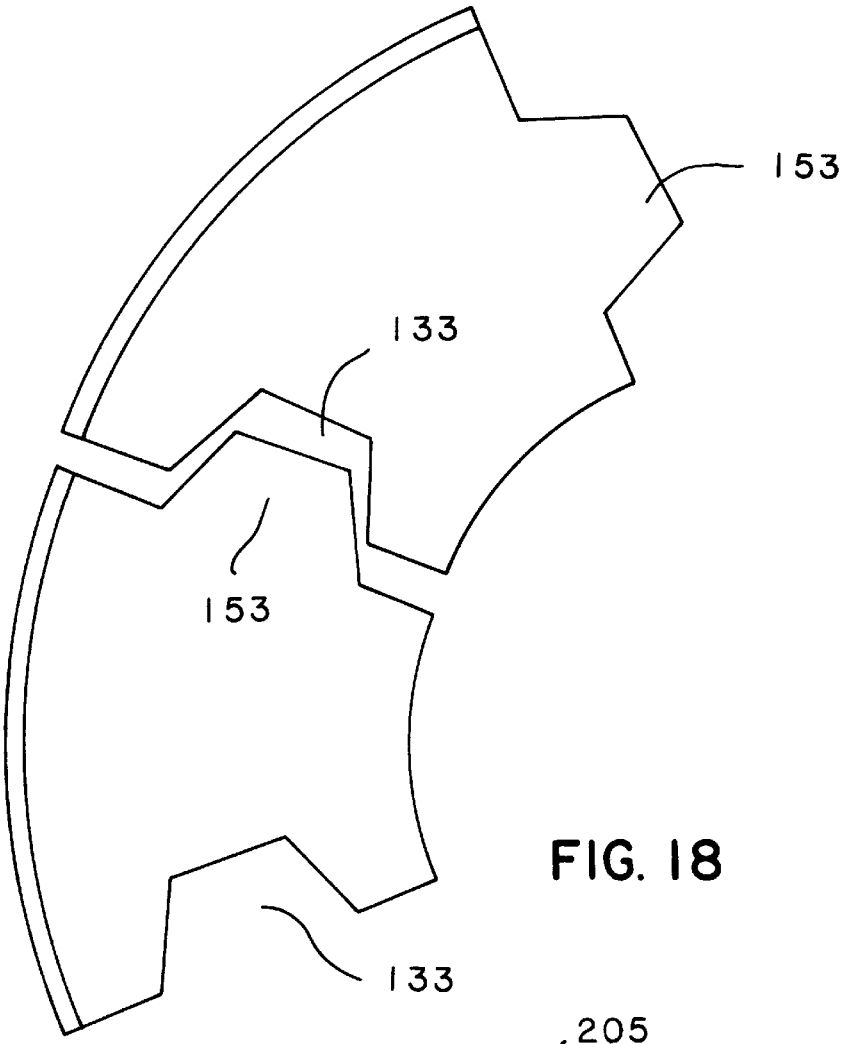
FIG. 18 represents a top elevational view of the curvilinear masonry building units shown in FIGS 16 and 17 juxtaposed.

FIG. 18 shows how two curvilinear masonry building units according to the present invention which include the protuberance and the cut-out portion are oriented with respect to each other in a structure including such masonry units.

Figure 19:
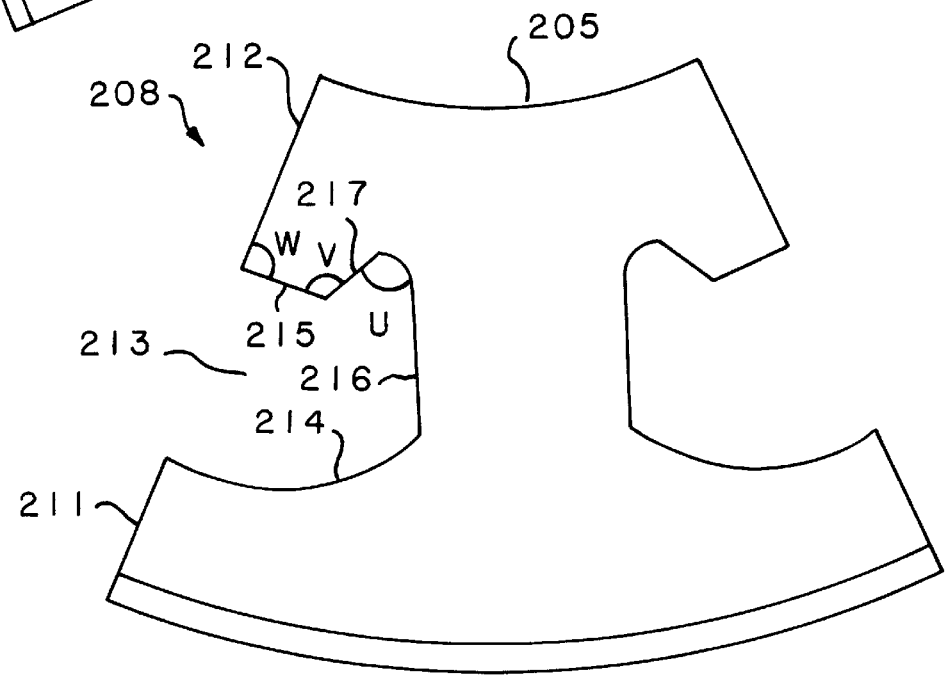
FIG. 19 represents a top elevational view of a curvilinear masonry building unit having a cut out portion in a side wall pursuant to an alternative embodiment on the present invention.
Figure 20:
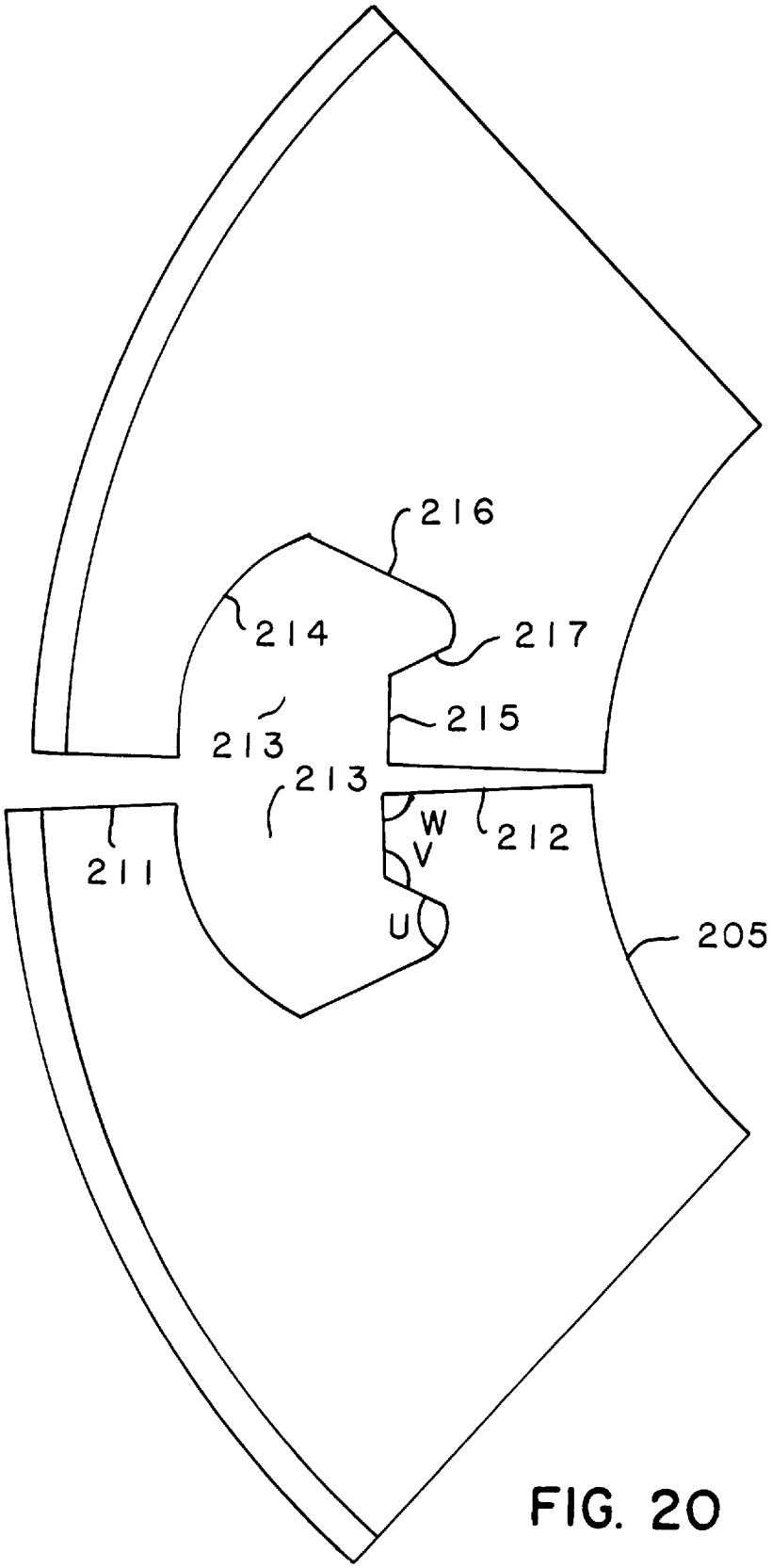
FIG. 20 represents a top elevational view of a corner turn employing two of the masonry units pursuant to FIG. 19.

FIG. 19 is a top elevational view of a curvilinear masonry building unit having a cut-out portion in a side wall. The cut-out portion in this embodiment provides for enhanced structural reinforcement of a corner fabricated using such a unit. The reinforcement can be provided by providing a mortar bed in the recess (e.g.—"buttering the joint") or pouring cement in the recess created by the cut-out portion, and, if desired, reinforcing rods or other such structure can also be provided in the recess. The presence of the projection or "ear-like" portion in the cut-out portion provides for a physical interlock of adjoining masonry units (see also FIG. 20).

The cut-out portion included in the side face of the curvilinear masonry building unit merely needs to large enough to provide the desired additional strength with the maximum size being primarily limited by merely assuring the integrity of the building unit during handling and construction and by economics. In addition, the location of the cut-out portion is typically such that the length of the side wall adjacent to each end of the cutout portion is at least 1.5 inches and preferably about 1.65 inches to ensure against a portion of a block breaking off during handling and construction. The additional projection in the cut-out portion typically extends at least about one-eighth inch beyond the main body of the cut-out portion. The specific dimensions for the cutout portion and location for a particular embodiment can be determined by those skilled in the art once aware of this disclosure without undue experimentation.

The embodiment of the present invention showing FIG. 19 can be provided in the form of an unglazed or raw block as well as a glazed block. The front face of the curvilinear masonry building unit includes a curvilinear portion that is opposite to a back face of the unit. The front face may also include one or more planar portions intersecting a curvilinear portion and the side faces.

In the embodiment shown in FIG. 19 side face 208 includes segments 211 and 212 with cut-out portion 213 located therebetween. In this embodiment, segment 211 is about 1.75 inches long, segment 212 is about 4.0 inches long and cut-out portion 213 includes opposing side walls 214 and 215. In this embodiment, wall 215 is about 0.75 inch long. Side wall 215 intersects segment 216. Side wall 214 intersects projection 217.

Projection 217 is recessed and extends beyond the main body of cut-off portion 213 and beyond one of the side walls of the cut-out portion. In FIG. 19, projection 217 extends beyond side wall 215 towards back wall 205. The projection upon application of mortar or cement provides for mechanical interlocks which can not be pulled apart without destroying the block itself.

Angles U, V, and W are 75°, 120°, and 90° respectively, in this embodiment.

With any of the above-described curvilinear masonry building units including a cut out portion in the side face, either one or both of the side faces may include a cut out portion. The cut out portion may abut another wall including a cut out portion in the side face, or a stretcher member including a cut out portion in the side face. In an embodiment including a cut out portion in both side faces, the cut out portion could abut a stretcher member, two stretcher members, a curvilinear masonry building unit and a stretcher member, or curvilinear masonry building units. Alternatively, a curvilinear masonry building unit according to the present invention may include a cut out portion in only one side face. This cut out portion may also abut a stretcher member, two stretcher members, a curvilinear masonry building unit and a stretcher member, or curvilinear masonry building units.

In an embodiment in which the side face includes a protuberance, the side face of a curvilinear masonry building unit may include one protuberance and one corresponding cut out portion. Alternatively, a unit may include a protuberance formed on one side face and a planar surface on the other side face. Further, a curvilinear masonry building unit according to the present invention may include two protuberances received by abutting curvilinear or stretcher units.

As is evident from the above discussion, a curvilinear masonry unit according to the present invention may include any desired configuration of side wall cut out and protuberance portions. The number and size of the cut outs and protuberances may depend upon the application in which the units are used.

Preferably, the side faces 6 and 7 intersect with a back face 9. The back face 9 of a curvilinear masonry building unit according to the present invention preferably includes a curvilinear portion 10 matching the curvature of the curvilinear portion 4 of the front face 2. In the embodiment shown in FIG. 5, the curvilinear portion 10 of the back face 9 of the curvilinear masonry building unit 1 matches the curvilinear portion 4 of the front face 2 of the building unit 1 so that the unit is of a uniform thickness over its entire length. In other words, the front face and the back face are the same straight line distance apart over their entire lengths.

In this embodiment, the curvilinear portion 10 of the back face 9 represents the same portion of a circle as does the curvilinear portion 4 of the front face 2 of the building unit 1. However, the section of the circle of the curvilinear portion 10 of the back face 9 would have a radius of about 7.375 inches. As with the front face 2, this represents approximately 44° of the circle. The length of the arc of the curvilinear portion 10 of in back face 9 in the embodiment shown in FIG. 5 is about 5.8 inches. The straight line distance between the two corners 9*a* and 9*b* is about 5.75 inches in this embodiment.

Also, in this embodiment, the side faces 6 and 7 form an angle about 90° with the point at which they intersect the curvilinear back portion of the back face 9. Therefore, the side faces 6 and 7 would form about a 90° angle with a tangent to a circle of which the curvilinear portion represents a portion of at the point where the side faces intersect the back face. Even in the embodiments described above which the side faces include a cut-out portion, the side faces preferably also include a planar portion adjacent to the back face. Although the angle between the back face and the side faces in the embodiment shown in FIG. 5 is about 90°, the angle may be formed of any size according to the desired application. If the angle is smaller than 90°, the back face may represent a larger portion of the circle than is shown in FIG. 5. If the angle is smaller than 90°, the curvilinear portion may represent a smaller section of the circle than is represented in FIG. 5.

The back face 9 of a curvilinear masonry building unit 1 according to the present invention may also be formed without a curvilinear portion. For instance, side faces 6 and 7 in the embodiment shown in FIG. 5 may be represented by a flat back face. However, the back face may be curved in the opposite direction of the back face shown in FIG. 5. Still further, the back face curvilinear masonry unit 1 shown in FIG. 5 may include more than one segment. For instance, the back face 9 shown in FIG. 5 may be formed for two flat faces following substantially the same path as the curvilinear portion 10.

In embodiments of the present invention in which the front face 2 includes a planar portion 5, the back face 9 may also include a planar portion 12 intersecting the curvilinear portion 10 as shown in FIG. 6. In an embodiment in which the front face 2 includes a planar portion 5 intersecting opposite sides of the curvilinear portion 4 of the front face 2 of the curvilinear masonry building unit 1, the back face of the unit may include two planar portions formed on opposite sides of the curvilinear portion 10 of the back face 9. If the curvilinear portions 4 and 10 of the front face 2 and back face 9, respectively, of the curvilinear masonry building unit 1 represent an arc of the same number of degrees and the planar portions 5 and 12 of the front face 2 and back face 9, respectively, of the unit 1 are the same length, then the front and back faces of the unit may be the same distance apart over the length of the unit.

In the embodiment shown in FIG. 6, the planar portions of the front and back faces are about 7.65 inches long. However, the planar portions of the front and back faces may be formed of any length. Additionally, it is not necessary that the planar portions of the back face be the same as the planar portion of the front face. In fact, in the embodiment shown in FIG. 6, rather than having a back face 9 comprising a curvilinear portion 10 and a planar portion 12, the back face of the masonry unit 1 may be a single planar portion joining the two corners 9*a* and 9*b* of the masonry unit 1. Although the intersections between the, side face and back face are shown as sharp well defined corners in the embodiment shown in FIGS. 5 and 6, if desired, the intersection faces can be rounded off or truncated.

Regardless of the embodiment of the curvilinear masonry building unit according to the present invention, a glaze composition may also be applied to the back face of the unit. In referring to the back face, it is intended to refer to the portion of the curvilinear masonry building units discussed above referred to as the back portion. In other words, a glaze composition may also be applied to the concave curvilinear portion of the units. However, if the back face is not curvilinear, a glaze composition may still be applied to it.

Figure 21:
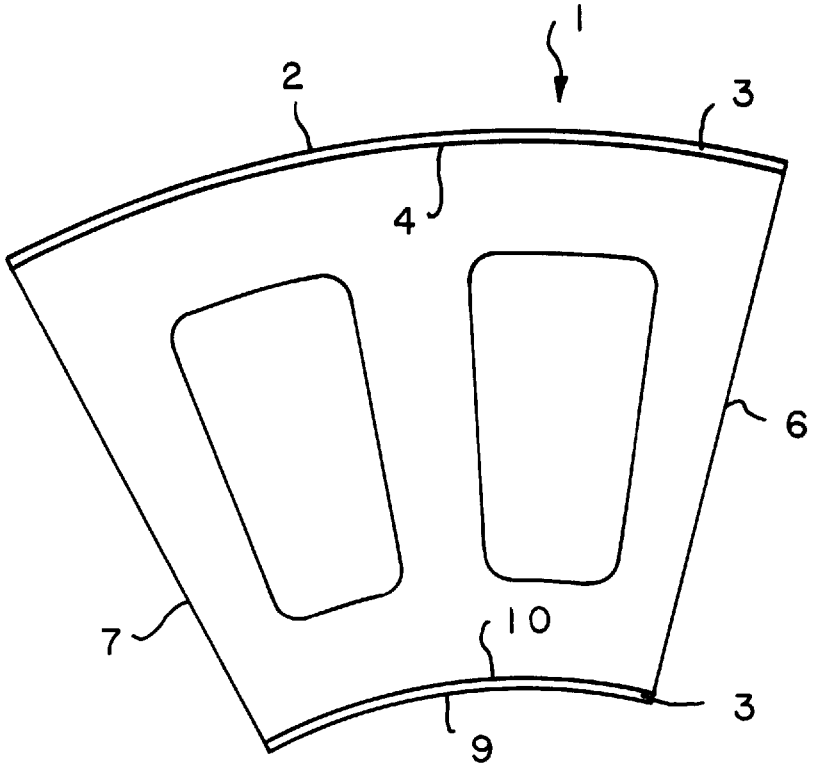
FIG. 21 represents a top elevational view of a curvilinear masonry building unit including a back face having a concave curvilinear portion to which a glaze composition has been applied.
Figure 22:
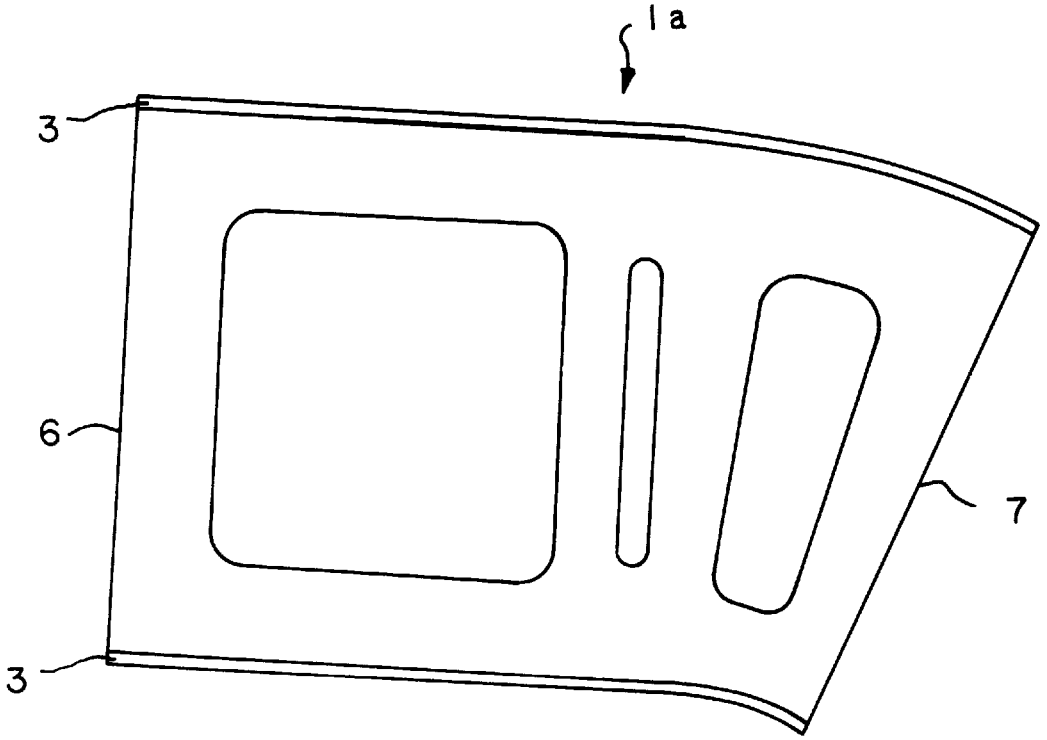
FIG. 22 represents a top elevational view of a curvilinear masonry building unit including both a front face having a convex curvilinear portion and a back face having a concave curvilinear portion to which a glaze composition has been applied.

As stated above, the glaze composition may be applied to the face which is intended to be exposed. In an embodiment in which the back face may be intended to be exposed, the back face may be glazed. Alternatively, both the front and back face of the curvilinear masonry building units may be intended to be exposed. In such an embodiment, a glaze composition may be applied to both faces. FIGS. 21 and 22 represent embodiments of curvilinear masonry building units according to the present invention which have a glaze composition applied to both the front and back faces. The curvilinear masonry building units of these embodiments are similar to the embodiments shown in FIGS. 5 and 6, respectively.

Figure 7:
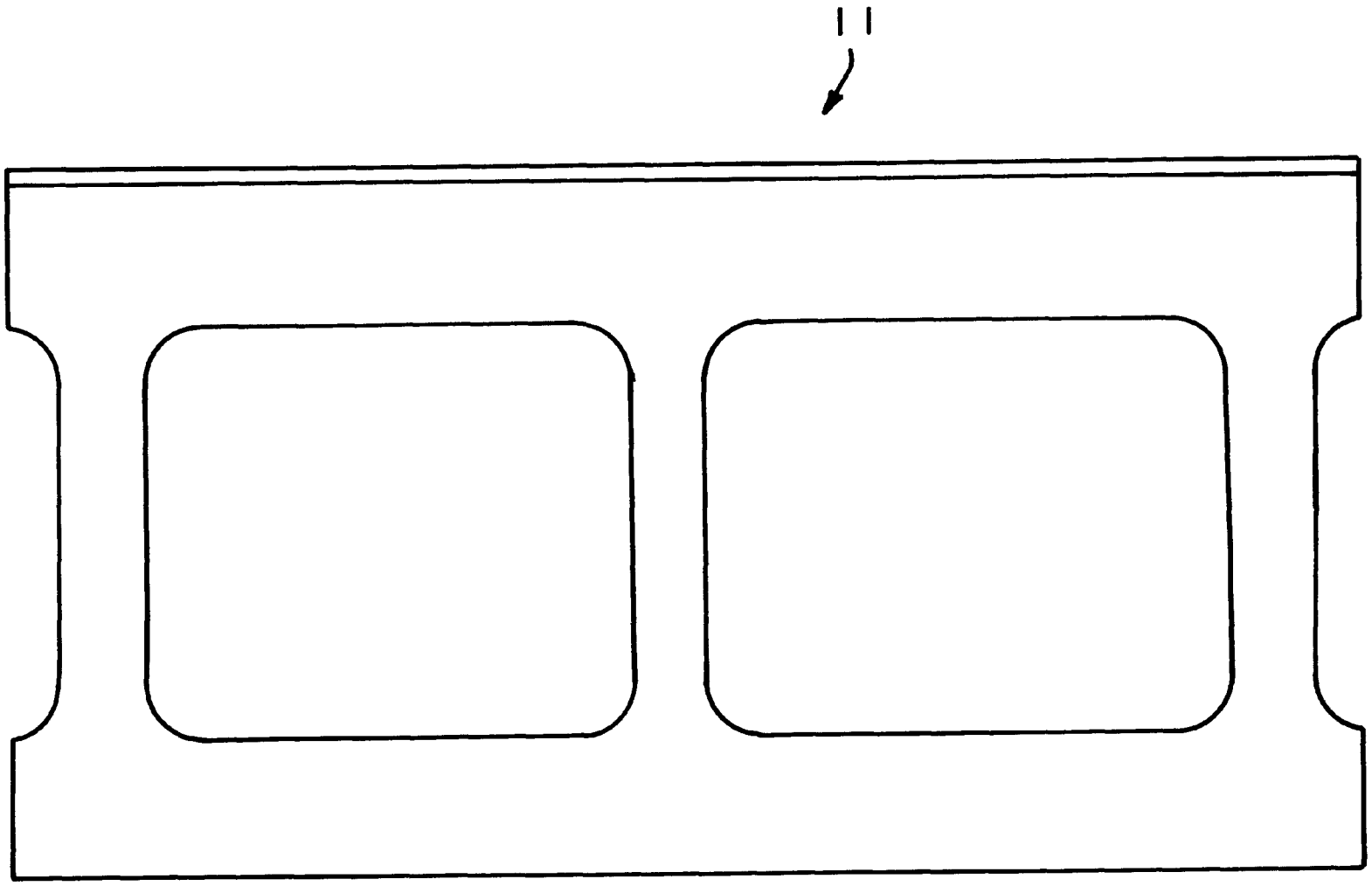
FIG. 7 represents a top elevational view of a stretcher masonry building unit which may be used in an embodiment of a wall corner according to the present invention.
Figure 8:
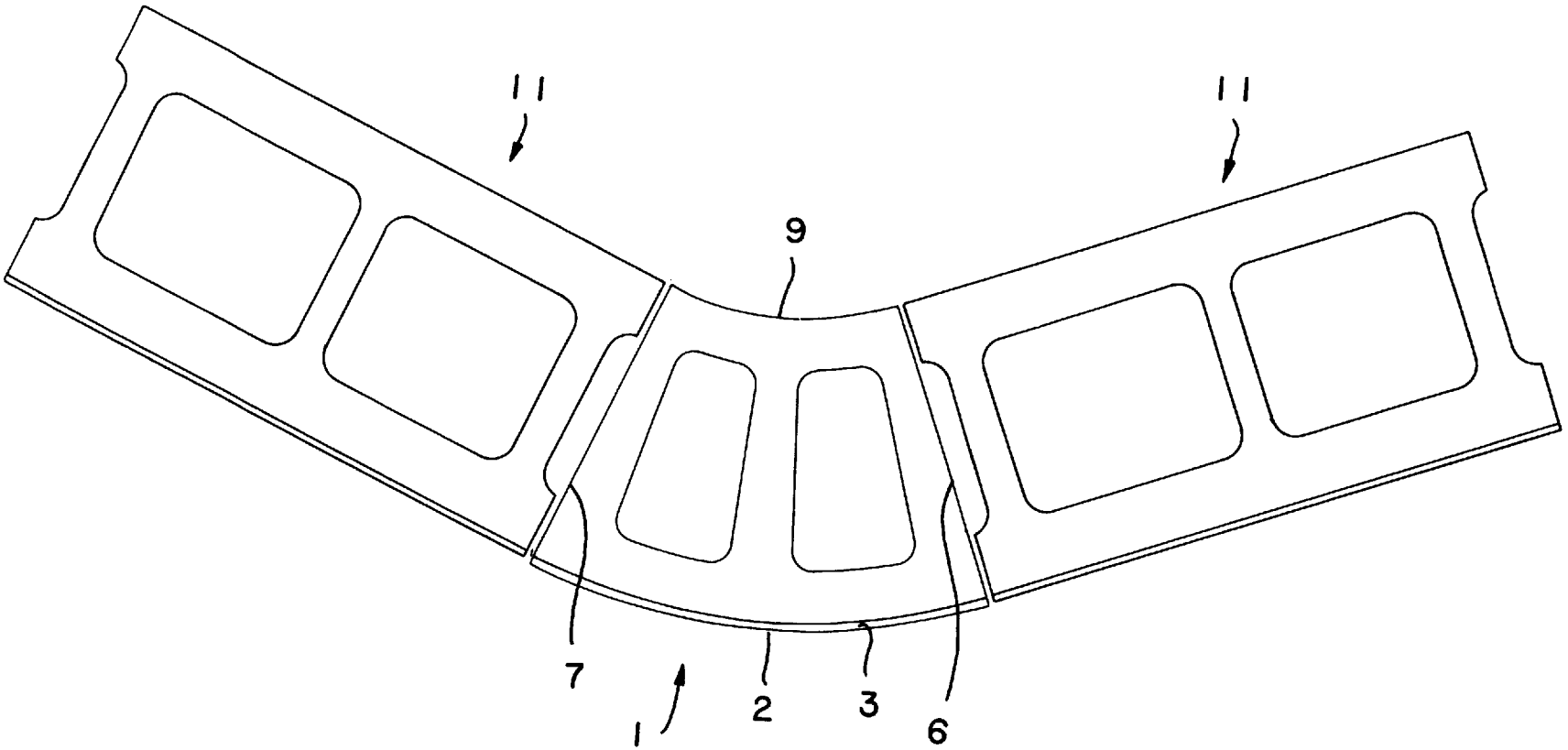
FIG. 8 represents a top elevational view of one embodiment of a section of wall pursuant to the present invention.

FIG. 7 shows a stretcher member which may be used in walls incorporating curvilinear masonry building units according to the present invention. FIG. 8 shows one embodiment of such a wall. This wall includes a curvilinear masonry building unit 300 similar to that shown in FIG. 5. Abutting each of these side walls 306 and 307 of the building unit 300 is a stretcher member 400. The stretcher members preferably are substantially similar to stretcher members shown in FIG. 7. The angle of the corner formed in the wall shown in FIG. 8 is approximately 44°. As can be seen in FIG. 8, both the curvilinear masonry building unit and the stretcher members may be glazed.

Figure 9:
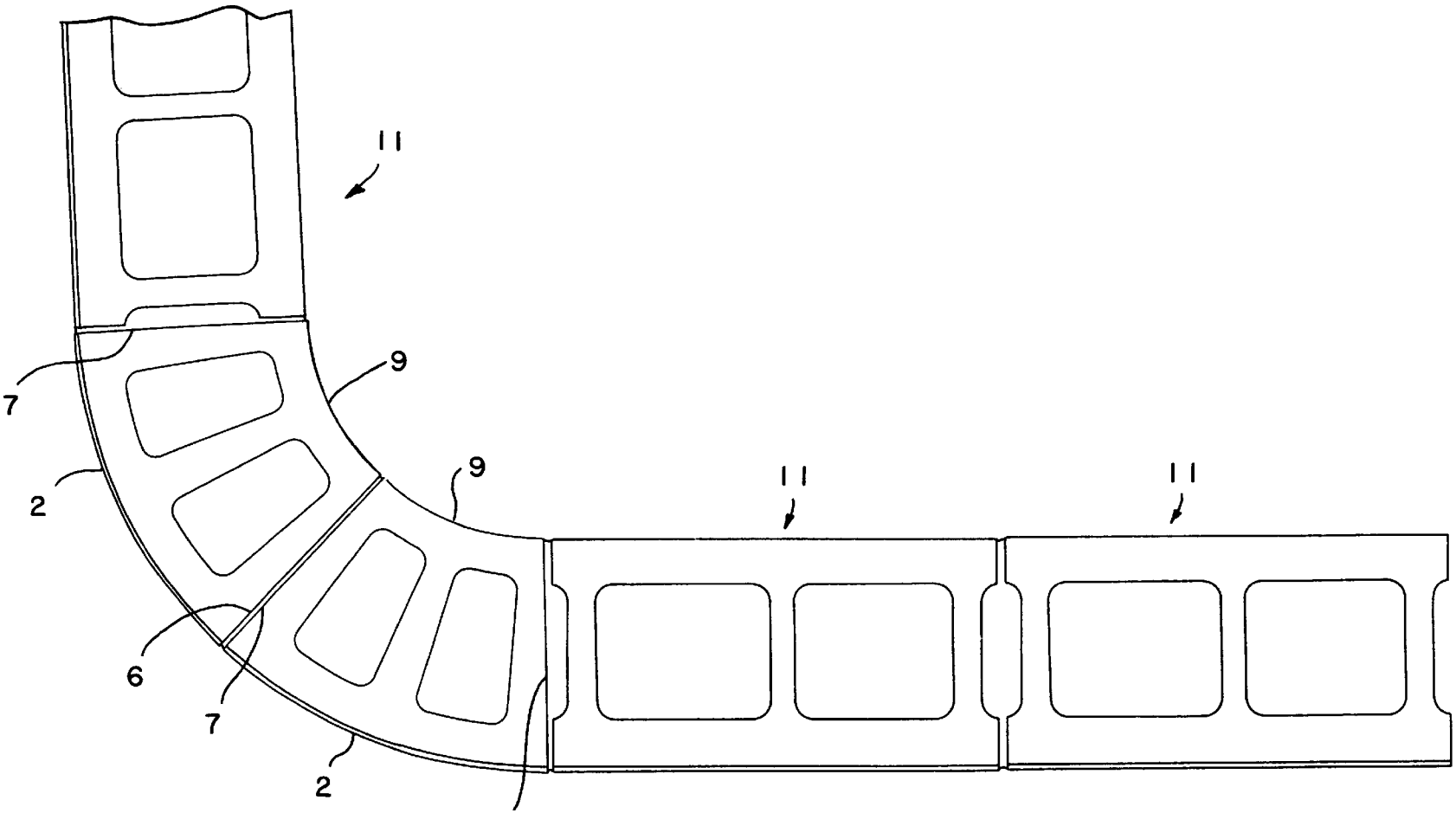
FIG. 9 represents a top elevational view of a second embodiment of a section of a wall pursuant to the present invention.

FIG. 9 shows an alternative embodiment of a wall including curvilinear masonry building units according to the present invention. The corner wall composite shown in FIG. 9 includes two curvilinear masonry building units 400 substantially similar to the units shown in FIG. 5. The corner turned by the wall composite shown in FIG. 9 is approximately 90°. As can be seen, a plurality of stretcher units may abut the curvilinear masonry building units extending the wall in the directions the side faces of the unit's face.

Figure 10:
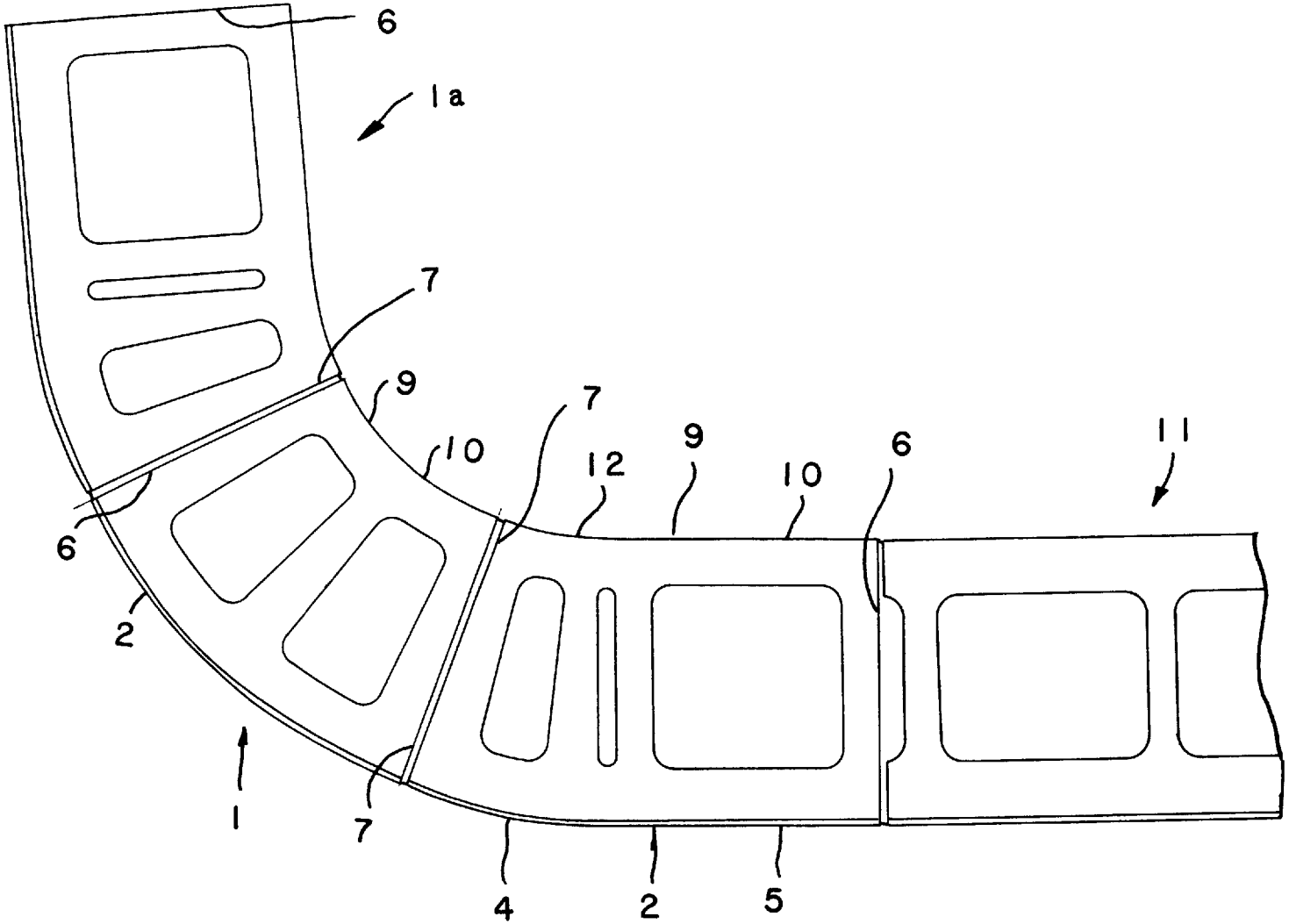
FIG. 10 represents a top elevational view of third embodiment of a section of wall pursuant to the present invention.
Figure 11:
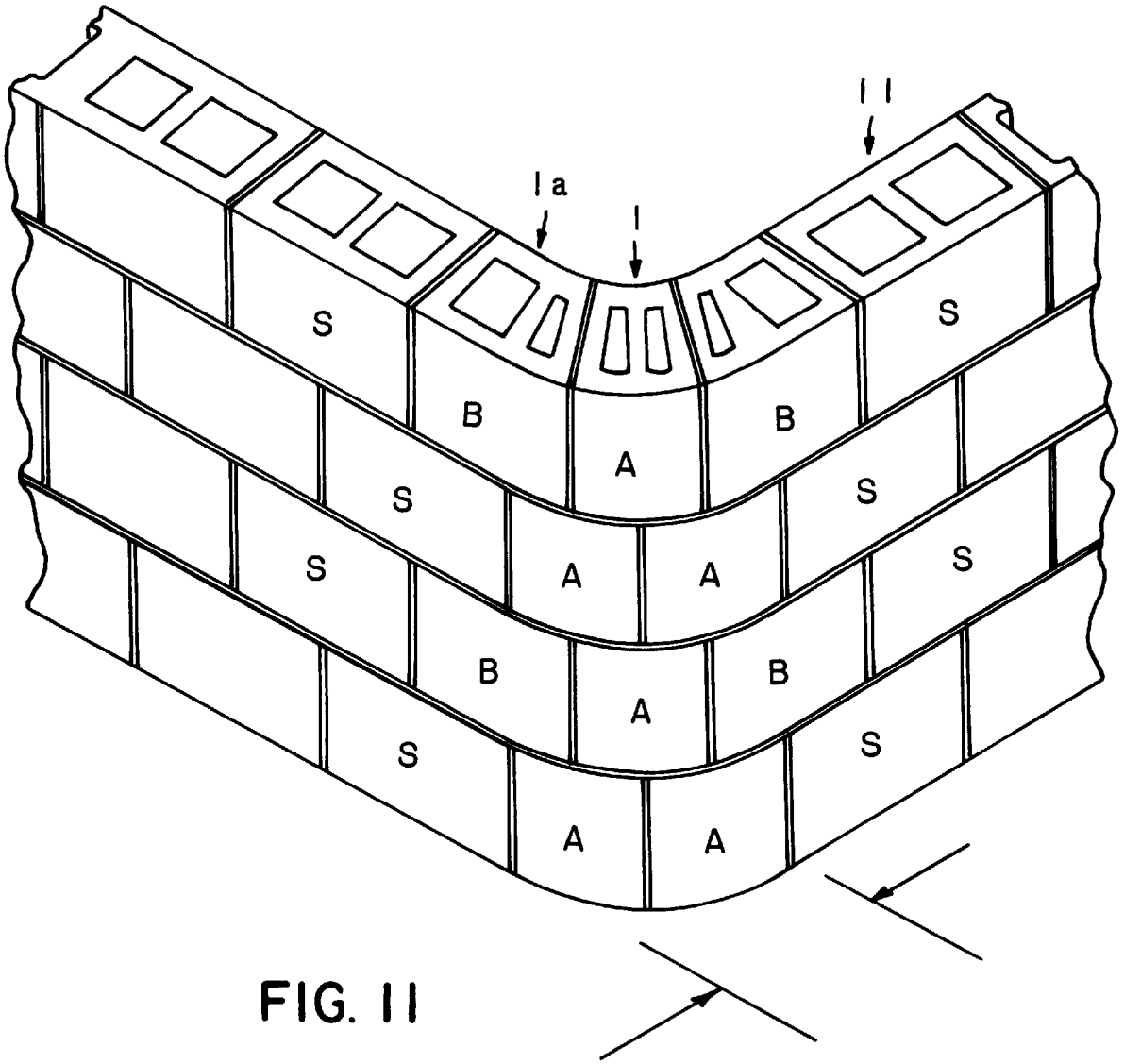
FIG. 11 represents an isometric view of one embodiment of a section of wall pursuant to the present invention.
Figure 12:
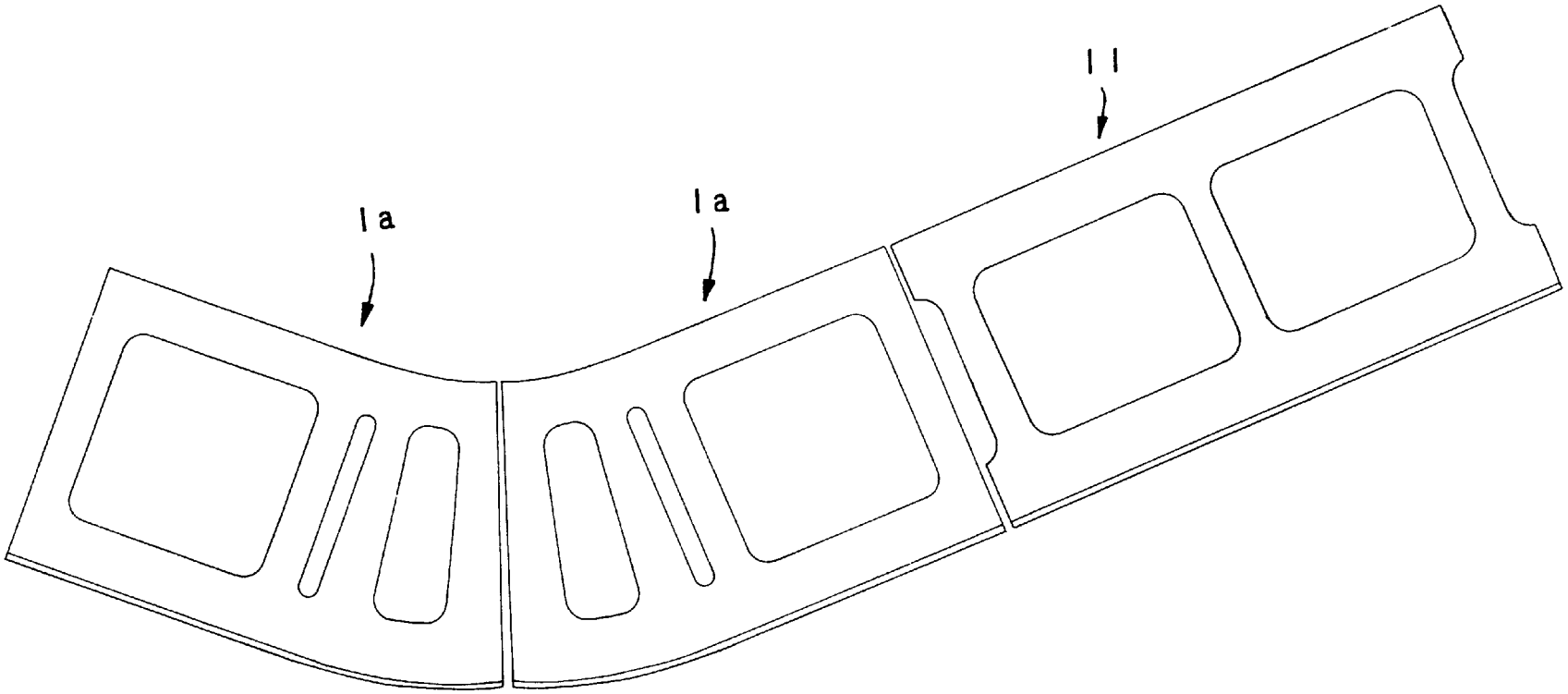
FIG. 12 represents a top elevational view of a fourth embodiment of a section of a wall pursuant to the present invention.

The wall composite shown in FIG. 10 includes 3 curvilinear masonry building units according to the present invention. The wall composite shown in FIG. 10 includes a curvilinear masonry building unit 500 similar to the embodiment shown in FIG. 5 sandwiched between two curvilinear masonry building units 501 similar to the embodiment shown in FIG. 6. As shown in FIG. 11, the wall corner composite shown in FIG. 10 may be alternated in a wall with the wall corner composite shown in FIG. 9. Both of the embodiments shown in FIG. 9 and FIG. 10 may be used to turn a 90° corner. By alternating the embodiments of the corner wall composite shown in FIG. 9 and FIG. 10, the masonry seams between the curvilinear masonry building units in the wall, as shown in FIG. 11, will be discontinuous, thereby providing additional strength to the wall and making it more architecturally aesthetic. FIG. 12 shows another embodiment of a corner wall composite formed using curvilinear masonry building units according to the present invention. The masonry units used to form the wall shown in FIG. 11 are substantially similar to those embodiments shown in FIG. 5.

The embodiments of corner wall composites shown in FIGS. 8–12 are only three examples of corner wall composites which may be formed according to the present invention. Any number of variations of corner wall composites including among others, the embodiments of curvilinear masonry building units shown in FIGS. 5 and 6 may be formed according to the invention. Additionally, any other embodiments of curvilinear masonry building units according to the present invention having different sizes, lengths of curvilinear sections and various numbers of planar sections on the front faces of the units may be included in corner wall composites according to the invention.

Figure 13:
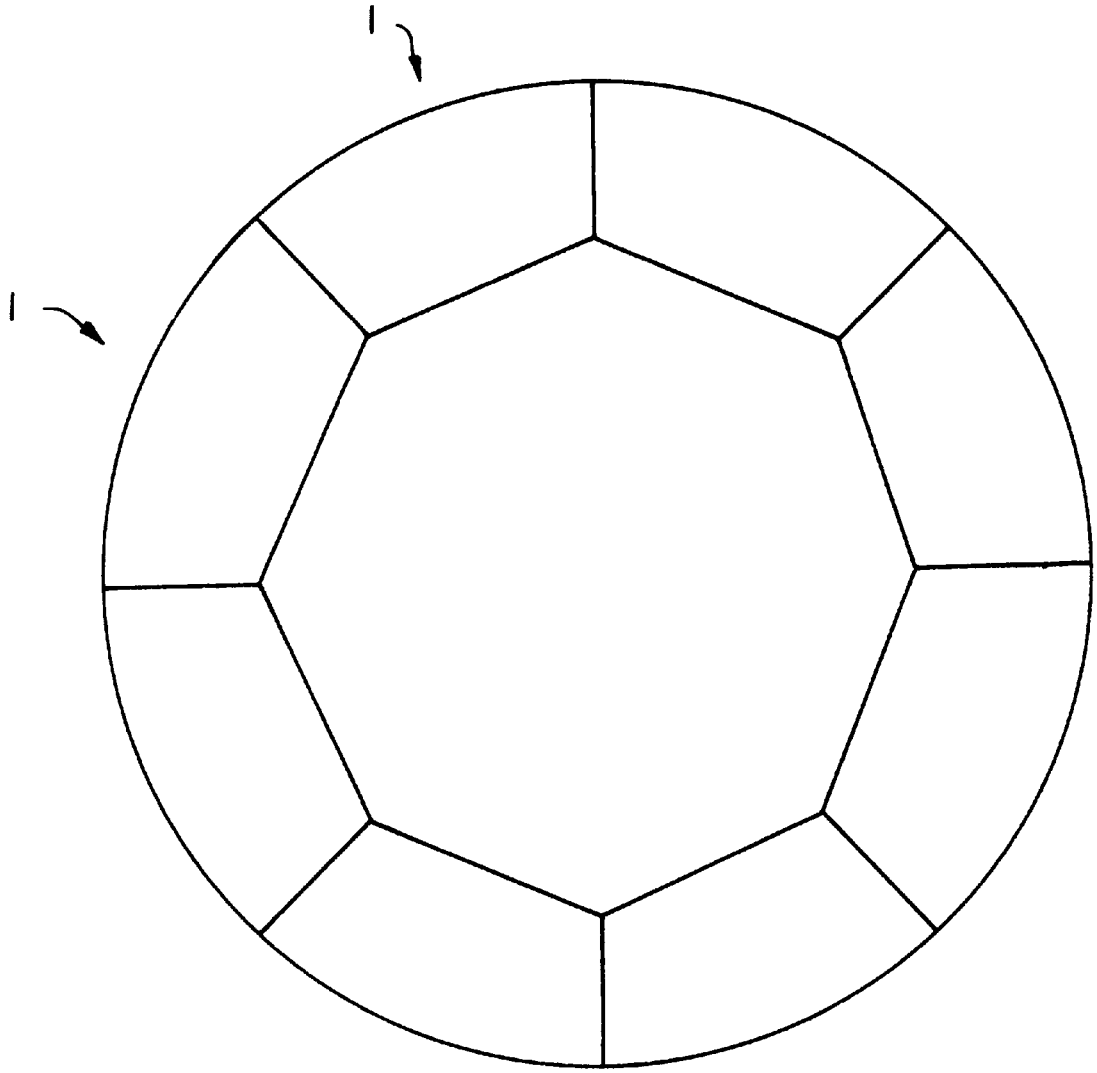
FIG. 13 represents a top elevational view of a column composite according to one embodiment of the present invention.

FIG. 13 shows a column composite formed according to the present invention. Of course, any of the types of curvilinear masonry building units as disclosed by the present invention could be employed in the corner wall composite or a portion thereof according to the present invention. The curvilinear masonry building units in the embodiment shown in FIG. 13 are oriented to each other so that the side face of one unit is opposed the side face of an adjacent masonry building unit. In addition, in FIG. 13 adjacent rows of curvilinear masonry building units lie in opposite direction from each other in order to stagger to the mortar joint in the direction of the column. If desired, the rows of curvilinear masonry building units can lie in the same direction or in any combination of the same and opposite directions. In FIG. 13, the arc of each curvilinear masonry building unit is about 44°. Therefore, eight curvilinear masonry building units are required for achieving a complete 360° column. The number of curvilinear masonry building units for achieving a complete 360° column is readily determined by those skilled in the art without under experimentation. In particular, one merely needs to divide 360° by the number of degrees represented by the arc of the curvilinear section of the front face of the curvilinear masonry building unit, providing that the front face of the unit does not include any planar portions and the curvilinear portion of the front face of the unit represents a section of a circle. It is further noted that, if desired, the present invention can be used to provide only a portion of a 360° column.

The various walls, wall composites, and column composites which may be formed according to the present invention may include curvilinear masonry building units which may have a glaze composition applied to either the front face, the back face, or both the front and rear faces.

The present invention also includes a method of applying a glaze to a curvilinear masonry building unit. The method of the present invention contemplates applying a glaze composition to the front and/or back faces of a curvilinear masonry building unit. The front and/or back faces may have a convex or concave curvilinear portion as well as one or more planar portions.

According to the method of the present invention, the desired glaze composition is first applied to a mold. Preferably, the mold includes at least a curvilinear portion matching the curvilinear portion of the front face 2 of the curvilinear masonry building unit which the glaze composition is to be applied. If the front face of the curvilinear masonry building unit also includes a planar portion, than preferably, the mold also includes a planar portion intersecting the curvilinear portion or two planar portions on opposite sides of the curvilinear portion in the case where the front face includes two planar portions.

According to the method, the desired glaze composition is applied to the curvilinear portion and also, possibly, the planar portion of the mold to the desired thickness. Typical glaze thicknesses are about one-eight inch to about three-quarter inch. Also, typical compositions are in the form of a relatively viscous slurry having a ratio of filler to liquid of about 2.5:1 to about 7:1 and/or typically about 4.0:1 to about 4.5:1. The glaze composition can be uniformly distributed over the curvilinear and also possibly the planar portion with as (at the end of the mold by employing a mechanical device such as a shaker and vibrator as known in the art next, the curvilinear masonry building unit is placed in the mold so that at least a portion of the front face of the curvilinear masonry building unit is in contact with the glaze composition. The curvilinear masonry building unit can either be pre-molded to the desired shape or it can be cut from a standard rectangular shaped block.

According to preferred aspects of the present invention, the curvilinear masonry building unit is then vibrated and at the same time forced into the glaze composition previously placed in the mold. As the curvilinear masonry building unit is forced further into the mold, the glaze will be forced to travel up the sides of the curved portion of the mold between the mold surface and the front face 2 of the unit. An amount of glaze composition necessary to coat the entire front face 2 of the curvilinear masonry building unit may be placed into the mold prior to inserting the unit into the mold. Alternatively, once the curvilinear masonry building unit has been forced into the glaze so that the glaze is at the desired thickness on the portions of the unit covered with glaze, additional glaze may be added to the mold to coat the remaining uncoated portions of the front face. Sufficient glaze may be added to the mold to allow the glaze composition to at least partially coat the side faces in addition to the front face. Also, as stated above, additional glaze may be added to the mold after the curvilinear masonry building unit has been inserted.

Other materials in addition to the glaze composition may also be added to the mold. For instance, aggregate, typically sand, may be placed around the edges of the curvilinear masonry building unit between the inside of the side walls of the mold and the unit. The mold may then be filled to the top with the aggregate. The aggregate typically has a particle size of about 30 to about 150 mesh. The aggregate is wetted by a wicking action from the slurry and the facilitates glazing of the curvilinear masonry building unit.

After this, putty such as that commercially available clay or more commonly molding clay can be securely placed between the curvilinear masonry building unit and the angle portion of the mold. However, the clay next, the glazing composition may then be poured into the cavity remaining between the curvilinear masonry building unit and the mold on the inside of the angled portion of the mold for the angled segment of the unit. The lip provides for glazing of the corresponding portion of the curvilinear masonry building unit. The putty or clay helps in conjunction with the curvilinear masonry building unit to maintain the slurry in place for glazing the unit, while filling and going through the cure cycle.

After the glaze and/or other materials have been added to the mold and the curvilinear masonry building unit inserted into the mold, the glazing composition is then cured. The curing can be carried out at room temperature if desired, depending upon the specific compositions selected. Preferably, it is carried out at an elevated temperature of about 150° F. to about 450° F. and more preferably to about 280° F. to 320° F. Typically, the temperature of the coating is raised to these levels at about 10 to 30 minutes and held there for a sufficient time such as 2 to 5 minutes to complete polymerization.

After the glaze is properly cured, the glazed curvilinear masonry building unit is removed from the mold.

As discussed above, a glaze composition may also be applied to a concave curvilinear front and/or back portion of a curvilinear masonry building unit according to the present invention. A method of applying a glaze composition to a concave portion preferably includes placing an amount of a glaze composition in a mold having a convex portion complementary to the concave portion on the unit. the unit may then be vibrated into the glaze composition. Additional materials may be added to the mold as discussed above. The additional steps disclosed above regarding the method of applying a glaze composition to a convex front face of a curvilinear masonry building unit according to the present invention may be added to the method of applying a glaze composition to the back face, whether the back face is concave, convex, planar, or any other surface.

Figure 23:
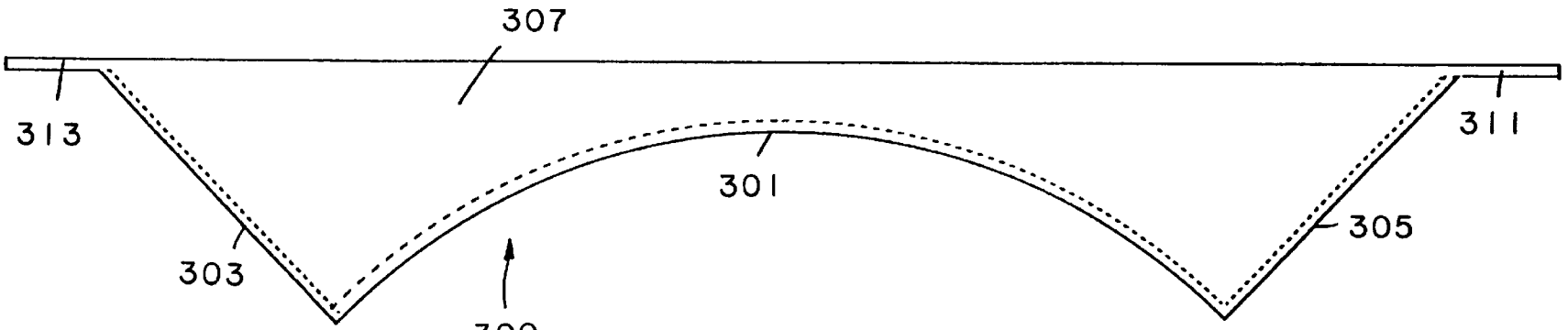
FIG. 23 represents a cross-sectional view of one embodiment of a mold used in applying a glaze composition according to a method of the present invention to a face, including a concave curvilinear portion, of a curvilinear masonry building unit according to the present invention.
Figure 24:
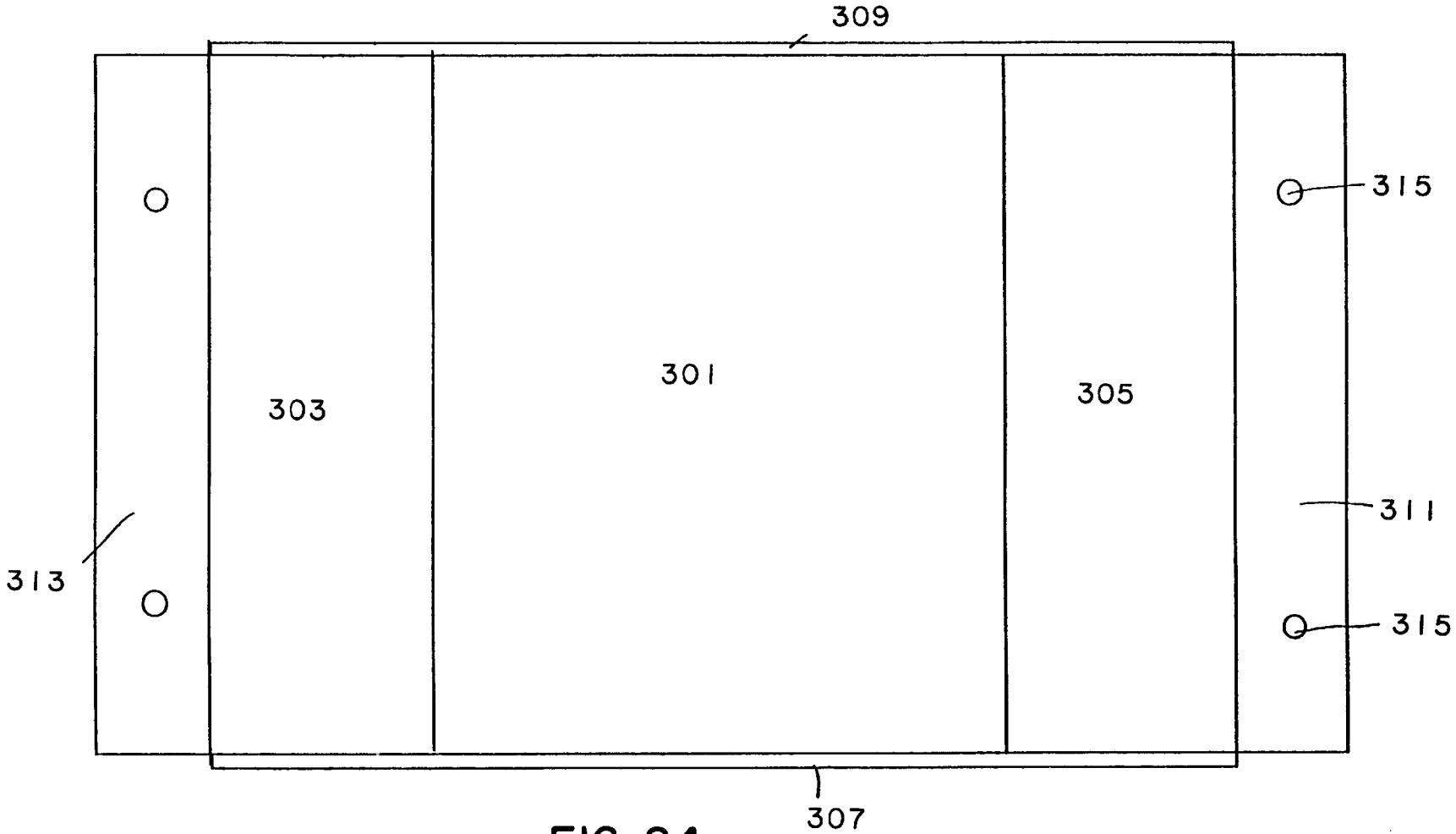
FIG. 24 represents an overhead view of the embodiment of the mold shown in cross-section in FIG. 23.
Figure 25:
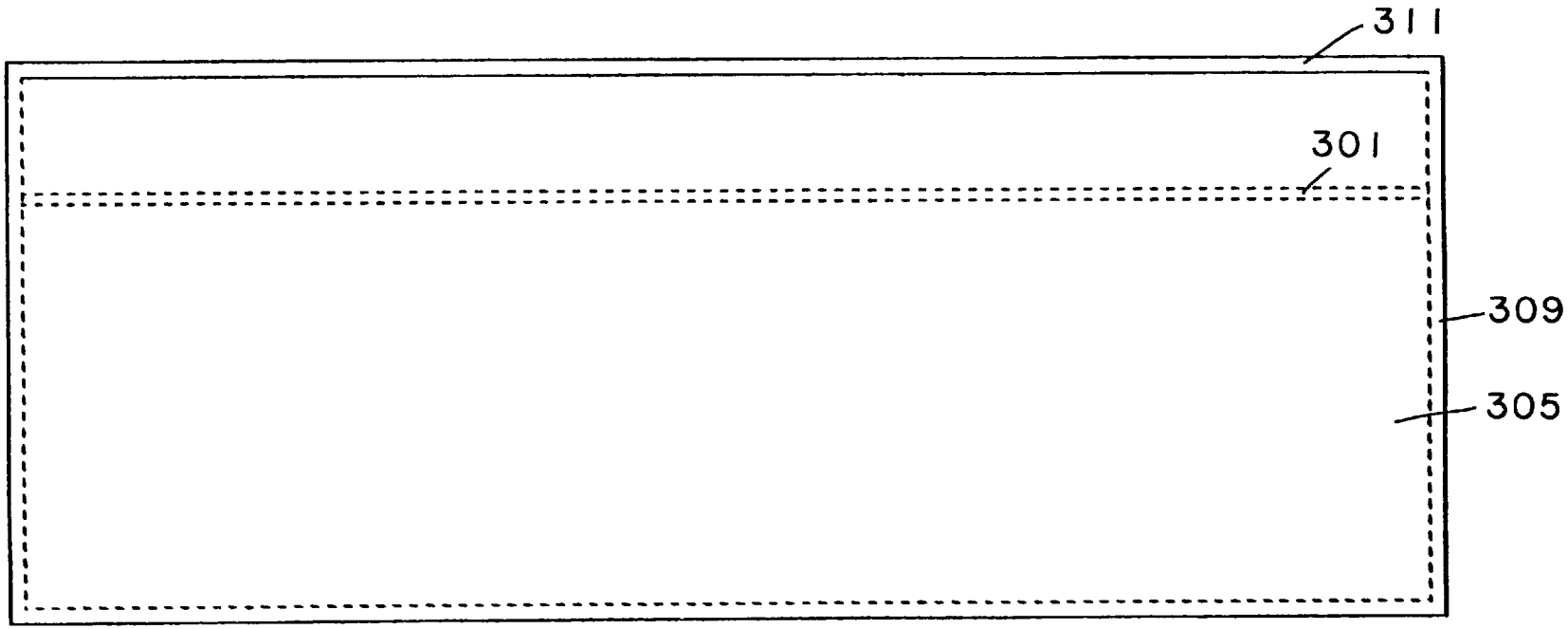
FIG. 25 represents a side view of the embodiment of the mold shown in FIGS. 23 and 24.

FIG. 23 shows a cross-sectional view of one embodiment of a mold 300 which may be used to apply a glaze composition to a curvilinear masonry building unit including a front and/or back face including a concave curvilinear portion. As such, mold 300 includes a complementarily shaped curvilinear portion 301. The curvilinear portion 301 of the mold 300 preferably intersects with mold end walls 303 and 305. Preferably, the end walls 303 and 305 of the mold 300 abut the side faces of a curvilinear masonry building unit to which a glaze composition is being applied. The curvilinear edges of the curvilinear portion 301 of the mold 300 and the edges of the end walls 303 and 305 of the mold 300 preferably intersect side walls 307 and 309 of the mold 300. In preferred embodiments, the side walls 307 and 309 of the mold 300 abut the top and bottom faces of a block in the mold. The edges of the end walls 303 and 305 of the mold intersect mold flanges 311 and 313. Each mold flange 311 and 313 may have holes 315 formed through it. FIG. 24 shows an overhead view of the embodiment of the mold shown in cross-section in FIG. 23. FIG. 25 shows an end view of the embodiment of the mold shown in FIG. 23.

In a typical embodiment, the mold shown in FIGS. 23–25 includes a curvilinear portion representing about a 45° arc with about a 7.75 inch radius. The minimum depth of the mold, from the surface of the curvilinear portion to the top of the side walls is about 0.75 inch. The linear distance from the ends of the curvilinear portion, where the curvilinear portion intersects the end walls is about 11 inches. The distance between where each end wall intersects the flanges is about 16.75 inches. The side walls preferably are about 7.78 inches apart at the top of the mold, away from where they intersect the curvilinear portion and the side walls, and about 7.73 inches apart at the point where they intersect curvilinear portion and the side walls. Therefore, the side walls preferably are angled outwardly at about a 1° angle.

The side walls may be angled at about 45° from a plane passing through the intersections of both side walls with the curvilinear portion. Also, in a typical embodiment, the flanges are about 1 inch wide and the holes in the flanges preferably are centered about 1.25 inch from the sides of the mold. Each of these dimensions may be altered, depending, at least in part, upon the curvilinear masonry building unit to which a glaze is being applied.

Figure 26:
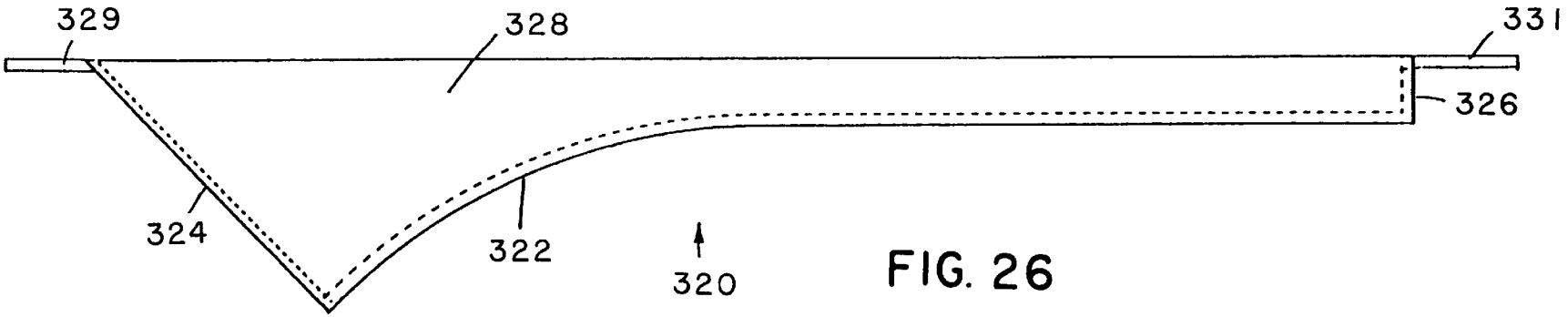
FIG. 26 represents a cross-sectional view of another embodiment of a mold used in applying a glaze composition to a face, which includes a concave curvilinear portion and a planar portion, of a curvilinear masonry building unit according to the present invention.

A curvilinear masonry building unit which has a front or back face including a concave curvilinear portion may also include a planar portion. A glaze composition may also be applied to the planar portion. FIG. 26 shows a cross-sectional view of a mold which may be used in the application of a glaze composition to the concave curvilinear portion of the front or rear face. Mold 320 preferably includes a bottom 322 having planar portion and a curvilinear portion including a curvature similar to that of the face of the masonry unit to which the glaze composition is being applied. The curvilinear portion of the mold preferably intersects an end wall 324 which, when the masonry unit is in the mold, abuts one of the side faces of the masonry unit. The other side face of the masonry unit abuts a short end wall 326 which intersects the end of the planar portion of the bottom of the mold. Side walls 328 and 330 of the mold intersect the edges of the bottom 322 of the mold 320 and the edges of the end walls 324 and 326. The mold may also include flanges 329 and 331. The flanges may have holes 332 formed in them, as shown in FIG. 27.

Figure 27:
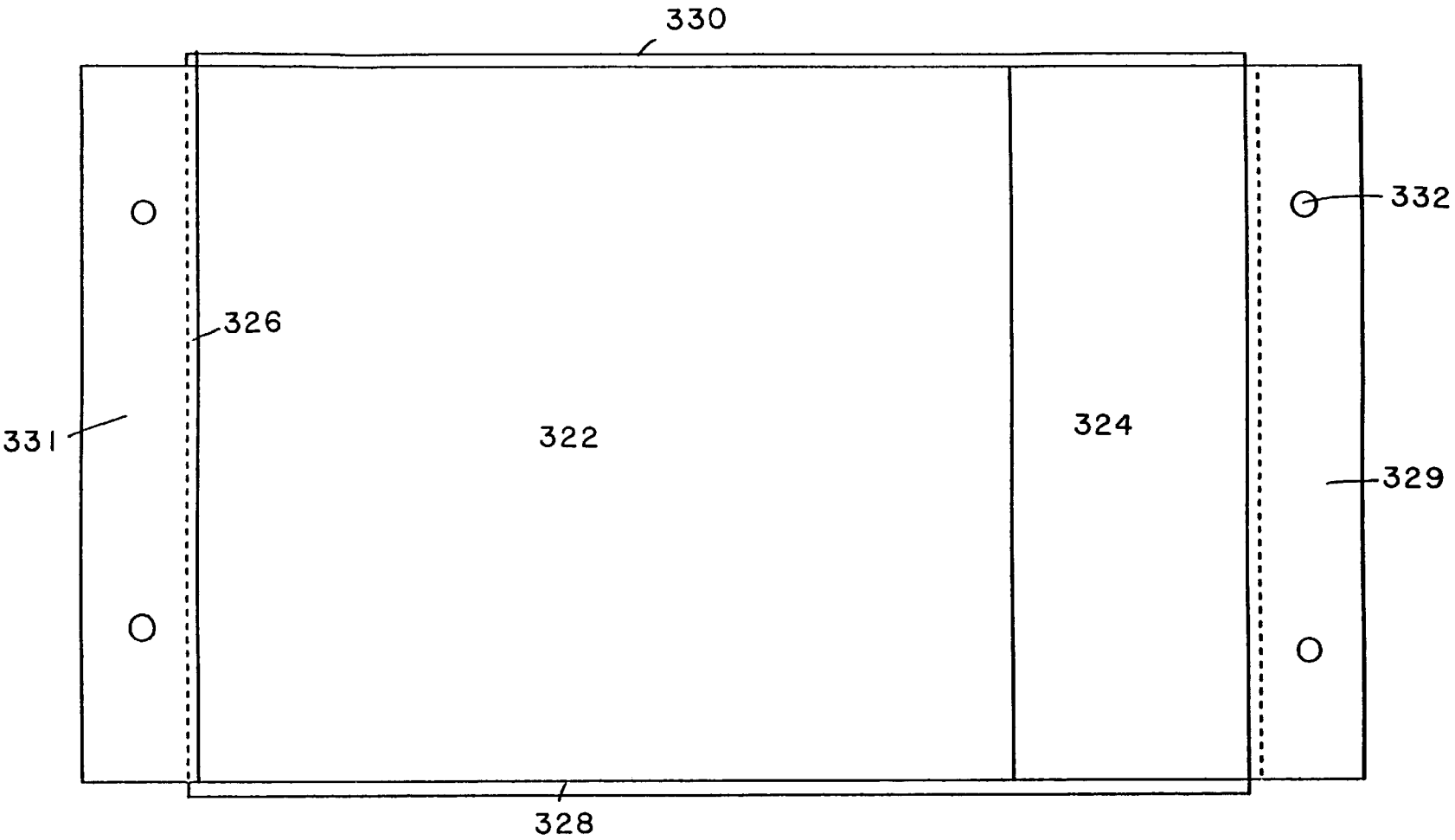
FIG. 27 represents an overhead view of the embodiment of the mold shown in cross-section in FIG. 26.
Figure 28:
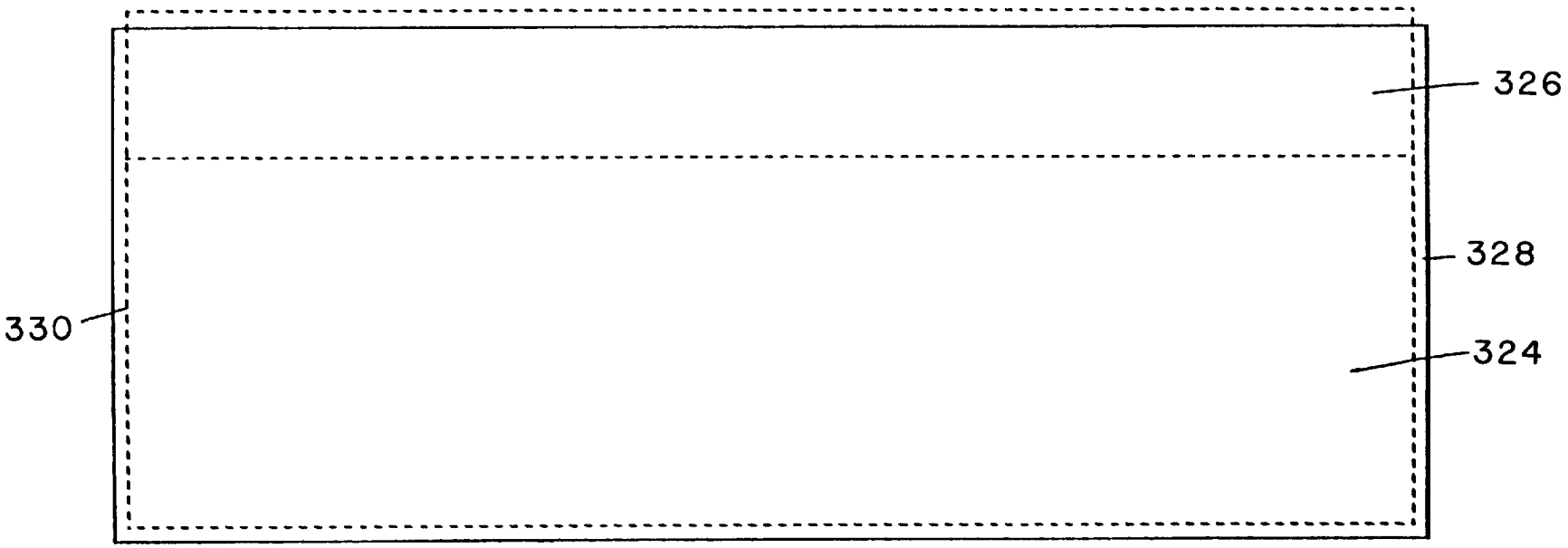
FIG. 28 represents a side view of the embodiment of the mold shown in FIGS. 26 and 27.

In a typical embodiment of the mold shown in FIGS. 26–28, the curvilinear portion represents an arc of about 45° with a 7.75 inch radius. The planar portion is about 7.78 inches long. The end wall preferably joined to the curvilinear portion of the mold preferably is at about a 45° angle in relation to a plane parallel to the planar portion of the mold and passing through the intersection of the end wall and the curvilinear portion. Preferably, the minimum depth of the mold, from the surface of the planar portion to the top of the side walls, is about 0.75 inch. The minimum depth may be about 3.0 inches. The distance along a line parallel to the planar portion of the mold from the intersection of the end wall and the curvilinear portion to the other end wall is about 13.28 inches. Preferably, the parameters discussed above concerning flanges, holes in the flanges, angle of the side walls, and width of the mold for the mold shown in FIGS. 23–25 are the same for the mold shown in FIGS. 26–28. As stated above, each of the above dimensions may be altered, depending, at least in part, upon the curvilinear masonry building unit to which a glaze is being applied.

To apply a glaze to a curvilinear masonry building unit having a front or back face including a concave curvilinear portion and possibly also one or two planar portions, the glaze composition may be applied to the face of the masonry unit, with the concave curvilinear portion facing upwards. Alternatively, the glaze composition may be applied to the surface of the mold. The block and/or the mold is then vibrated and simultaneously the block and the mold are forced toward each other. The additional steps discussed above of curing the glaze composition, adding various other materials to the mold, and curing the glaze composition, among others, may be repeated when applying a glaze composition to a curvilinear masonry building unit having a front or back face including a concave curvilinear portion and possibly one or more planar portions.

The methods of the present invention may also be used to apply a glaze composition to both the front and back faces of a block according to the present invention. According to such a method a glaze composition may be applied to either the front or back face. The glazed face may then be protected and a glaze composition applied to the other face.

Figure 29:
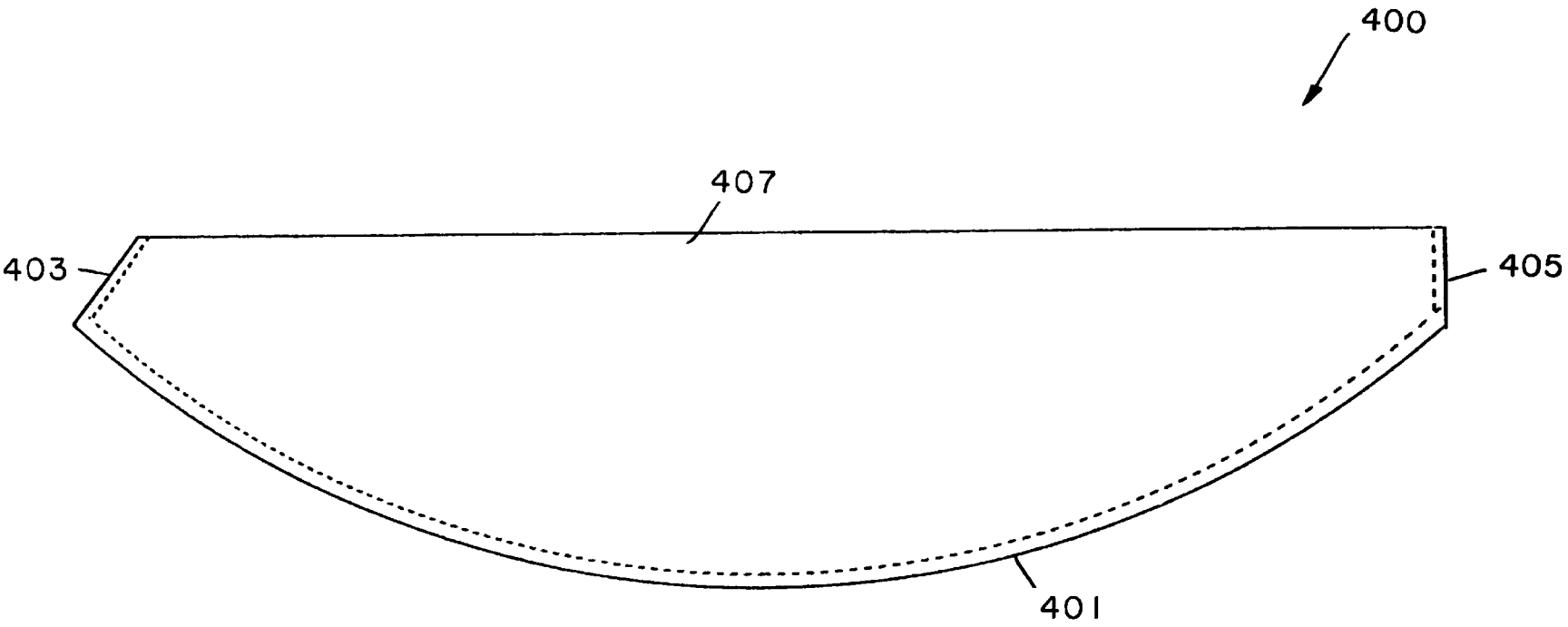
FIG. 29 represents a cross-sectional view of one embodiment of a mold used in applying a glaze composition according to a method of the present invention to a face, including a convex curvilinear portion, of a curvilinear masonry building unit according to the present invention.

FIG. 29 shows a cross-sectional view of one embodiment of a mold 400 which may be used to apply a glaze composition to a curvilinear masonry building unit including a front and/or back face including a convex curvilinear portion. As such, mold 400 includes a complementarily shaped curvilinear portion 401. The curvilinear portion 401 of the mold 400 preferably intersects with mold end walls 403 and 405. Preferably, the end walls 403 and 405 of the mold 400 abut the side faces of a curvilinear masonry building unit to which a glaze composition is being applied. In some embodiments, end wall 403 may be angled inwardly, as shown in FIG. 29.

Figure 30:
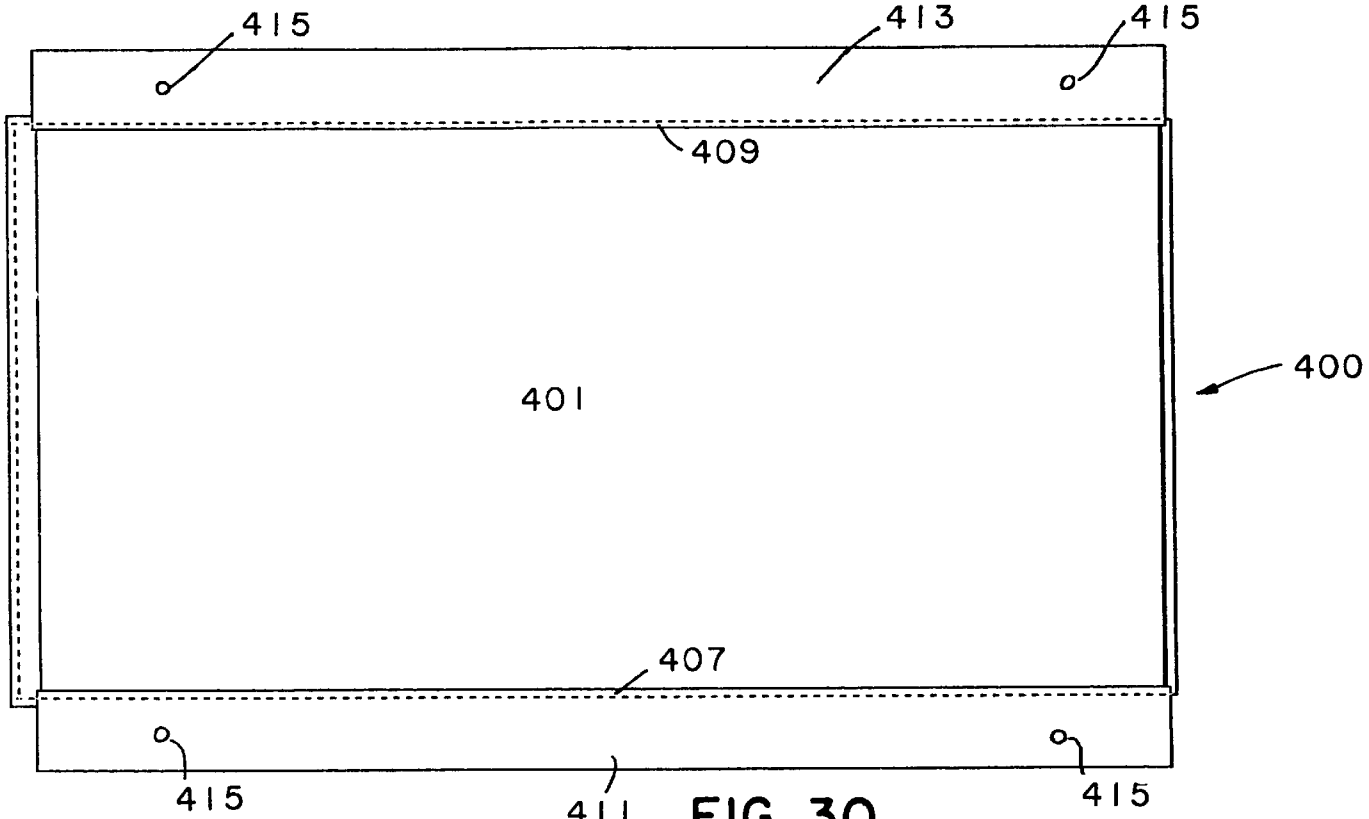
FIG. 30 represents an overhead view of the embodiment of the mold shown in cross-section in FIG. 29.
Figure 31:
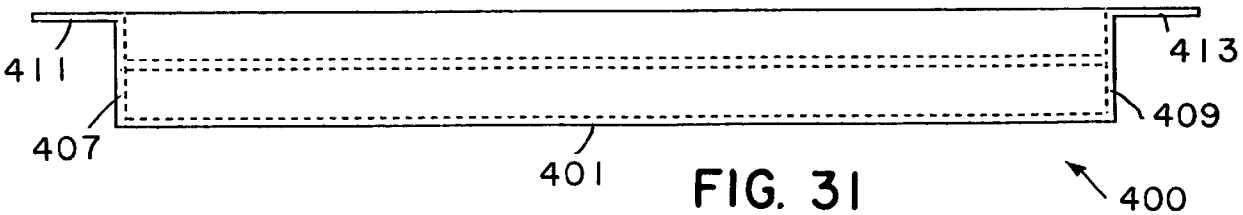
FIG. 31 represents a side view of the embodiment of the mold shown in FIGS. 29 and 30.

The curvilinear edges of the curvilinear portion 401 of the mold 400 and the edges of the end walls 403 and 405 of the mold 400 preferably intersect side walls 407 and 409 of the mold 400. In preferred embodiments, the side walls 407 and 409 of the mold 400 abut the top and bottom faces of a block in the mold. The edges of the end walls 403 and 405 of the mold intersect mold flanges 411 and 413. Each mold flange 411 and 413 may have holes 415 formed through it. FIG. 30 shows an overhead view of the embodiment of the mold shown in cross-section in FIG. 29. FIG. 31 shows an end view of the embodiment of the mold shown in FIG. 29.

In a typical embodiment, the mold shown in FIGS. 29–31 includes a curvilinear portion representing about a 45° arc with about a 16 inch radius. The linear distance from the ends of the curvilinear portion, where the curvilinear portion intersects the end walls is about 12 inches. The side walls preferably are about 7.78 inches apart at the top of the mold, away from where they intersect the curvilinear portion and the side walls, and about 7.73 inches apart at the point where they intersect curvilinear portion and the side walls. Therefore, the side walls preferably are angled outwardly at about a 1° angle.

The end wall 403 may be angled inwardly, toward the center of the mold. In the embodiment shown in FIG. 29, the end wall 403 is angled at about 93° with the curvilinear portion of the mold. On the other hand, the end wall 405 preferably is angled more outwardly as compared to the end wall 403. In the embodiment shown in FIG. 29, the end wall is angled at about 93° from a plane parallel to the top surface of the mold.

Also, in a typical embodiment, the flanges are about 1 inch wide and the holes in the flanges preferably are centered about 1.25 inch from the sides of the mold. Each of the above-described dimensions may be altered, depending, at least in part, upon the curvilinear masonry building unit to which a glaze is being applied.

Figure 32:
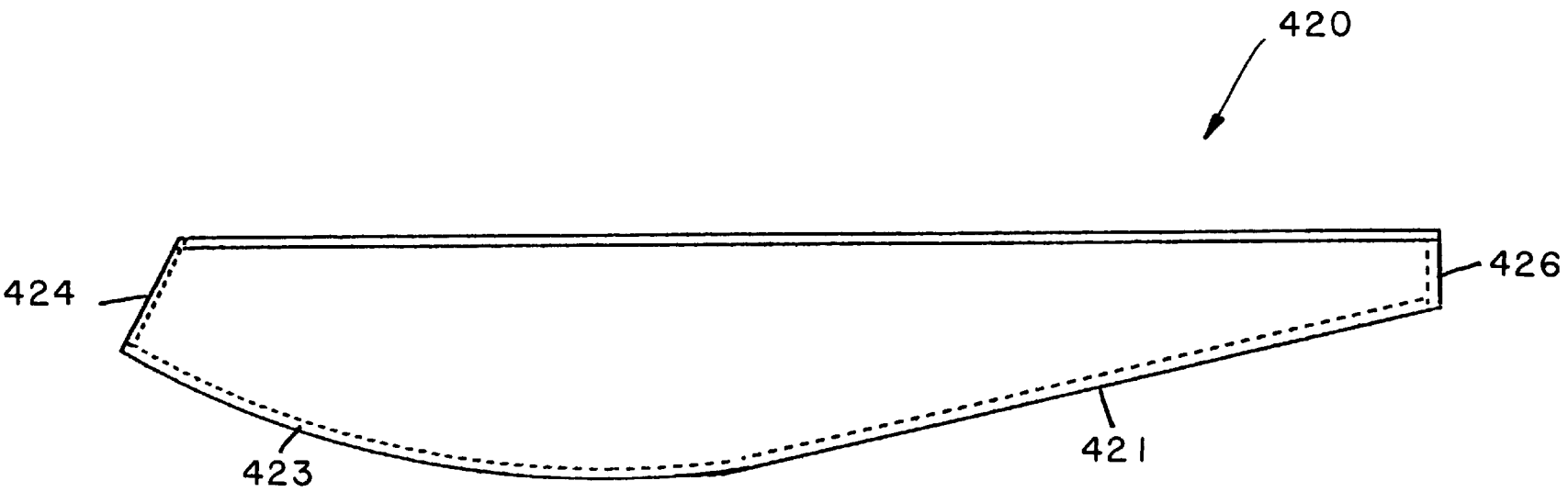
FIG. 32 represents a cross-sectional view of another embodiment of a mold used in applying a glaze composition to a face, which includes a convex curvilinear portion and a planar portion, of a curvilinear masonry building unit according to the present invention.

A curvilinear masonry building unit which has a front or back face including a convex curvilinear portion may also include a planar portion. A glaze composition may also be applied to the planar portion. FIG. 32 shows a cross-sectional view of a mold which may be used in the application of a glaze composition to the convex curvilinear portion of the front or rear face.

Mold 420 preferably includes a bottom 422 having planar portion 421 and a curvilinear portion 423 including a curvature similar to that of the face of the masonry unit to which the glaze composition is being applied. The curvilinear portion of the mold preferably intersects an end wall 424 which, when the masonry unit is in the mold, abuts one of the side faces of the masonry unit. The other side face of the masonry unit preferably abuts a short end wall 426 which intersects the end of the planar portion of the bottom of the mold. Side walls 428 and 430 of the mold intersect the edges of the bottom 422 of the mold 420 and the edges of the end walls 424 and 426. The end wall 424 preferably joined to the curvilinear portion of the mold preferably angled inwardly toward the center of the mold. On the other hand, the end wall 426 preferably is angled more outwardly than the end wall 424. The mold may also include flanges 432 and 434. The flanges may have holes 436 formed in them, as shown in FIG. 32.

Figure 33:
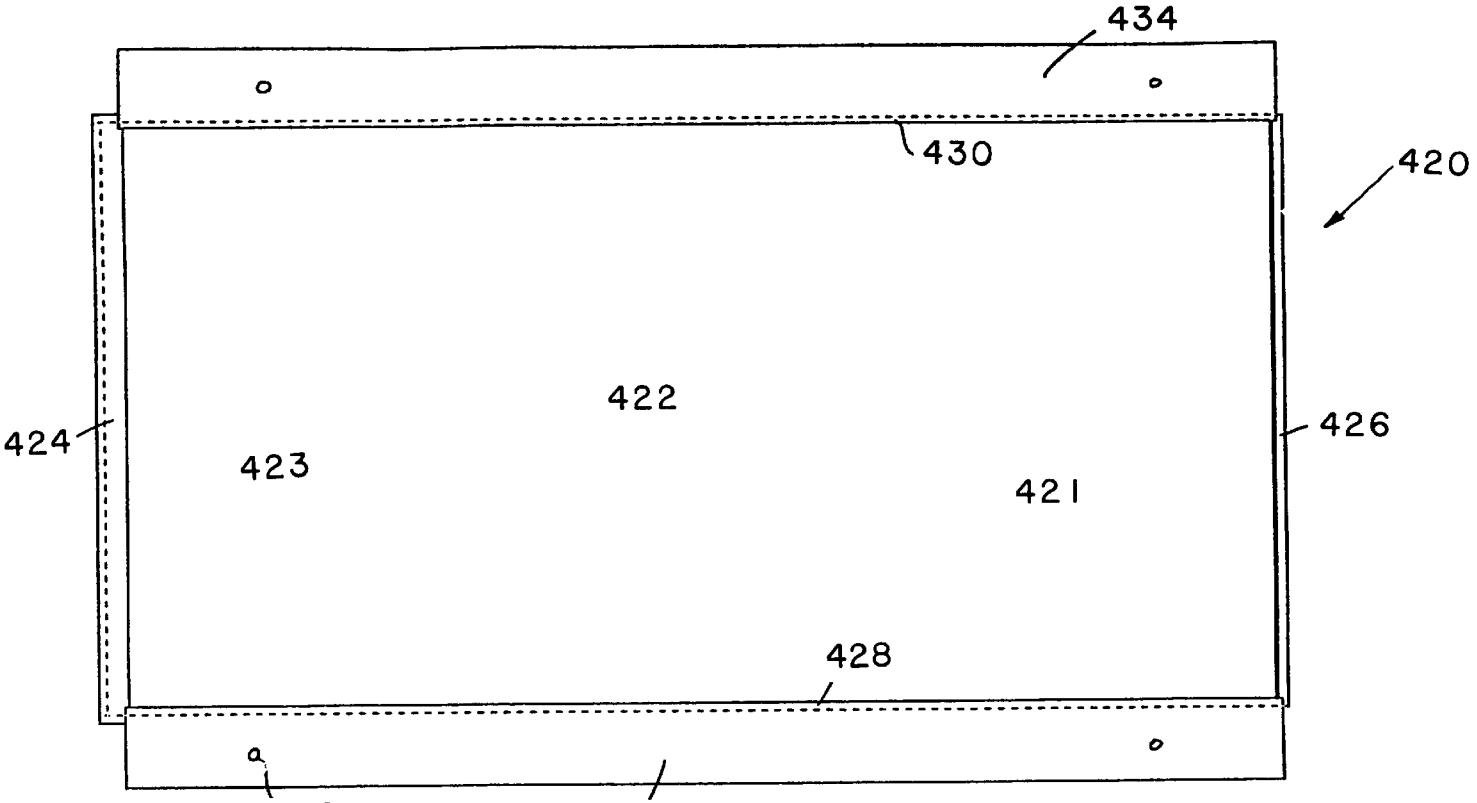
FIG. 33 represents an overhead view of the embodiment of the mold shown in cross-section in FIG. 32.
Figure 34:
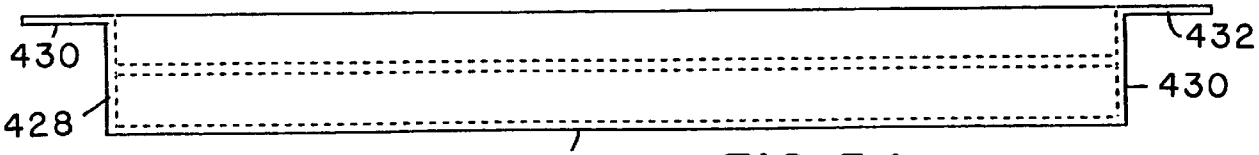
FIG. 34 represents a side view of the embodiment of the mold shown in FIGS. 32 and 33.

In a typical embodiment of the mold shown in FIGS. 32–34, the curvilinear portion represents an arc of about 45° with a 16 inch radius. The planar portion is about 7.78 inches long. The end wall 424 preferably forms a 93° with the curvilinear portion of the mold. On the other hand, the end wall 426 preferably forms a 93° angle with a plane parallel to the upper surface of the mold. Preferably, the parameters discussed above concerning flanges, holes in the flanges, angle of the side walls, and width of the mold for the mold shown in FIGS. 32–34 are the same for the mold shown in FIGS. 29–31. As stated above, each of the above dimensions may be altered, depending, at least in part, upon the curvilinear masonry building unit to which a glaze is being applied.

The method of applying the glaze composition to the masonry building units having a face(s) including a convex curvilinear portion may vary in a similar fashion as described above for units having a face(s) including a concave curvilinear portion.

While the present invention has been described with respect to various preferred aspects thereof, it will be appreciated that the present invention can be implemented by those skilled in the art once aware of the present invention to suit particular requirements. It will be understood that various changes and substitutions may be made within the sphere and scope of the invention as defined in the following claims.

What is claimed is:

1. A wall corner composite comprising:

at least one curvilinear masonry building unit, wherein said curvilinear masonry building unit comprises a front face, a back face, a top face, a bottom face, and two side faces wherein said front face is intended to be exposed and comprises a curvilinear portion that is opposite to said back face;

wherein said side faces of said at least one curvilinear masonry building unit are joinable to another masonry building unit with mortar; and wherein said at least one curvilinear masonry building unit is joinable to another masonry building unit to form a non-interlocking joint.

2. A wall corner composite according to claim 1, wherein said at least one curvilinear masonry building unit further comprises at least one cut out portion interposed between said front face and said back face.

3. A wall corner composite according to claim 1, wherein said at least one curvilinear masonry building unit further comprises means for receiving horizontally placed reinforcement rods.

4. A wall corner composite comprising:

at least two curvilinear masonry building units, wherein each of said curvilinear masonry building units comprises a front face, a back face, a top face, a bottom face, and two side faces wherein said front face is glazed with a resinous composition and is intended to be exposed and comprises a curvilinear portion that is opposite to said back face, said curvilinear portion intersecting said top face and said bottom face, wherein said at least two curvilinear masonry building units are joinable with mortar; and wherein said curvilinear masonry building units form a non-interlocking joint.

5. A wall corner composite, comprising:

at least one curvilinear masonry building unit, wherein said curvilinear masonry building unit comprises a front face, a back face, a top face, a bottom face, and two side faces wherein said front face is intended to be exposed and comprises a curvilinear portion that is opposite to said back face, said curvilinear portion intersecting at least said top face and said bottom face, wherein said side faces of said at least one curvilinear masonry building unit are joinable to another masonry building unit to form a non-interlocking joint.

6. A wall corner composite according to claim 5, wherein said at least one curvilinear masonry building unit wherein said side faces are joinable to another masonry building unit with mortar.

7. A wall corner according to claim 5, wherein said curvilinear portion of said at least one curvilinear masonry building unit is glazed with a resinous composition.

8. A wall corner according to claim 5, wherein said curvilinear portion of said curvilinear masonry building unit intersects said side faces.

9. A wall corner according to claim 5, wherein said curvilinear portion of said front face of said at least one curvilinear masonry building unit comprises an arc up to about 180°.

10. A wall corner according to claim 5, wherein said front face of said at least one curvilinear masonry building unit further comprises at least one planar portion that intersects said curvilinear portion and one of said side faces.

11. A wall corner according to claim 5, wherein said back face of said at least one curvilinear masonry building unit comprises a curvilinear portion.

12. A wall corner according to claim 5, wherein said front face of said at least one curvilinear masonry building unit comprises a first planar portion intersecting said curvilinear portion and a first side face, and a second planar portion intersecting said curvilinear portion opposite said first planar portion and intersecting a second side face.

13. A wall corner composite, comprising:

at least two curvilinear masonry building units, wherein said curvilinear masonry building units each comprise a front face, a back face, a top face, a bottom face, and two side faces wherein said front face comprises a curvilinear portion that is opposite to said back face, said curvilinear portion intersecting at least said top face and said bottom face, wherein said curvilinear masonry building units form a non-interlocking joint.

* * * * *